US008272766B2

(12) United States Patent
Phipps et al.

(10) Patent No.: US 8,272,766 B2
(45) Date of Patent: Sep. 25, 2012

(54) SEMICONDUCTOR LAMP WITH THERMAL HANDLING SYSTEM

(75) Inventors: J. Michael Phipps, Springfield, VA (US); Chad N. Sanders, Ashburn, VA (US); Steve S. Lyons, Herndon, VA (US)

(73) Assignee: ABL IP Holding LLC, Conyers, GA (US)

( * ) Notice: Subject to any disclaimer, the term of this patent is extended or adjusted under 35 U.S.C. 154(b) by 0 days.

(21) Appl. No.: 13/051,628

(22) Filed: Mar. 18, 2011

(65) Prior Publication Data

US 2011/0176316 A1 Jul. 21, 2011

(51) Int. Cl.
*F21V 29/00* (2006.01)

(52) U.S. Cl. ..... 362/294; 362/218; 362/373; 362/649; 362/646

(58) Field of Classification Search ..... 362/545, 362/547, 218, 294, 373, 646, 650, 649
See application file for complete search history.

(56) References Cited

U.S. PATENT DOCUMENTS 1,930,879 A * 10/1933 Linderoth et al. ..... 165/70
1,956,133 A * 4/1934 Rosenblad ..... 165/139
2,061,742 A * 11/1936 Swart ..... 55/490.2
2,142,679 A * 1/1939 Seifert ..... 165/79
2,856,161 A * 10/1958 Flynn ..... 165/129
3,376,403 A * 4/1968 Mircea ..... 219/618
3,486,489 A * 12/1969 Huggins ..... 123/41.33
4,729,076 A * 3/1988 Masami et al. ..... 362/235
5,785,418 A 7/1998 Hochstein
5,806,965 A * 9/1998 Deese ..... 362/249.04
5,857,767 A 1/1999 Hochstein
6,045,240 A 4/2000 Hochstein
6,311,764 B1 * 11/2001 Schulz et al. ..... 165/56
6,431,728 B1 8/2002 Fredericks et al.
6,450,661 B1 9/2002 Okumura
6,499,860 B2 12/2002 Begemann
6,517,217 B1 2/2003 Liao
6,578,986 B2 6/2003 Swaris et al.
6,580,228 B1 * 6/2003 Chen et al. ..... 315/185 R
6,598,996 B1 * 7/2003 Lodhie ..... 362/249.05
6,621,222 B1 9/2003 Hong
6,682,211 B2 1/2004 English et al.
6,709,132 B2 3/2004 Ishibashi
6,712,486 B1 3/2004 Popovich et al.
6,787,999 B2 9/2004 Stimac et al.
6,799,864 B2 10/2004 Bohler et al.
6,864,513 B2 3/2005 Lin et al.

(Continued)

OTHER PUBLICATIONS

Dr. S. Sunderrajan, President, "Delivering Tunable Color Quality with Compromise," Strategies in Light, The Leading Events for the Global LED Lighting Industry, NNCrystal US Corporation, Feb. 2011.

(Continued)

*Primary Examiner* — Ismael Negron
(74) *Attorney, Agent, or Firm* — McDermott Will & Emery LLP

(57) ABSTRACT

A lamp, for general lighting applications, utilizes solid state light emitting sources to produce and distribute white light. The exemplary lamp also includes elements to dissipate the heat generated by the solid state light emitting sources. The lamp includes a thermal handling system having a heat sink and a thermal core made of a thermally conductive material to dissipate the heat generated by the solid state light emitting sources to a point outside the lamp.

17 Claims, 10 Drawing Sheets

U.S. PATENT DOCUMENTS

| | | | | |
|---|---|---|---|---|
| 6,880,956 | B2 | 4/2005 | Zhang | |
| 6,948,829 | B2 | 9/2005 | Verdes et al. | |
| 6,969,843 | B1 | 11/2005 | Beach et al. | |
| 6,974,234 | B2 | 12/2005 | Galli | |
| 6,991,351 | B1 | 1/2006 | Petrick | |
| 7,058,103 | B2 | 6/2006 | Ishida et al. | |
| 7,086,767 | B2 | 8/2006 | Sidwell et al. | |
| 7,121,687 | B2 | 10/2006 | Sidwell et al. | |
| 7,148,632 | B2 | 12/2006 | Berman et al. | |
| 7,157,745 | B2 | 1/2007 | Blonder et al. | |
| 7,207,695 | B2 | 4/2007 | Coushaine et al. | |
| 7,210,832 | B2 * | 5/2007 | Huang | 362/294 |
| 7,226,189 | B2 | 6/2007 | Lee et al. | |
| 7,300,187 | B2 | 11/2007 | Huang et al. | |
| 7,314,291 | B2 * | 1/2008 | Tain et al. | 362/294 |
| 7,338,186 | B1 | 3/2008 | Wu et al. | |
| 7,345,320 | B2 | 3/2008 | Dahm | |
| 7,396,142 | B2 | 7/2008 | Laizure, Jr. et al. | |
| 7,488,093 | B1 | 2/2009 | Huang et al. | |
| 7,543,960 | B2 | 6/2009 | Chang et al. | |
| 7,547,124 | B2 | 6/2009 | Chang et al. | |
| 7,581,856 | B2 | 9/2009 | Kang et al. | |
| 7,588,351 | B2 | 9/2009 | Meyer | |
| 7,604,380 | B2 | 10/2009 | Burton et al. | |
| 7,641,361 | B2 | 1/2010 | Wedell et al. | |
| 7,708,452 | B2 | 5/2010 | Maxik et al. | |
| 7,740,380 | B2 | 6/2010 | Thrailkill | |
| 7,748,876 | B2 | 7/2010 | Zhang et al. | |
| 7,753,560 | B2 | 7/2010 | Xu et al. | |
| 7,755,901 | B2 | 7/2010 | Shen | |
| 7,768,192 | B2 | 8/2010 | Van De Ven et al. | |
| 7,824,075 | B2 | 11/2010 | Maxik | |
| 7,845,825 | B2 | 12/2010 | Ramer et al. | |
| 7,862,210 | B2 | 1/2011 | Zhang et al. | |
| 7,880,389 | B2 | 2/2011 | Imai et al. | |
| 2002/0012246 | A1 | 1/2002 | Rincover et al. | |
| 2004/0213016 | A1 * | 10/2004 | Rice | 362/547 |
| 2004/0251011 | A1 * | 12/2004 | Kudo | 165/172 |
| 2005/0068776 | A1 | 3/2005 | Ge | |
| 2005/0092469 | A1 | 5/2005 | Huang | |
| 2006/0092639 | A1 * | 5/2006 | Livesay et al. | 362/294 |
| 2006/0198147 | A1 | 9/2006 | Ge | |
| 2007/0241661 | A1 | 10/2007 | Yin | |
| 2007/0267976 | A1 * | 11/2007 | Bohler et al. | 315/112 |
| 2007/0285926 | A1 * | 12/2007 | Maxik | 362/294 |
| 2008/0093963 | A1 | 4/2008 | Marien et al. | |
| 2008/0290814 | A1 | 11/2008 | Leong et al. | |
| 2009/0002995 | A1 * | 1/2009 | Lee et al. | 362/294 |
| 2009/0073697 | A1 | 3/2009 | Peck et al. | |
| 2009/0097241 | A1 * | 4/2009 | Xu et al. | 362/234 |
| 2009/0251884 | A1 | 10/2009 | Rains | |
| 2009/0268461 | A1 | 10/2009 | Deak et al. | |
| 2009/0294780 | A1 | 12/2009 | Chon et al. | |
| 2009/0295266 | A1 | 12/2009 | Ramer et al. | |
| 2009/0296368 | A1 | 12/2009 | Ramer | |
| 2010/0027258 | A1 | 2/2010 | Maxik et al. | |
| 2010/0073924 | A1 | 3/2010 | Deng | |
| 2010/0103678 | A1 | 4/2010 | Van Den Ven et al. | |
| 2010/0133578 | A1 | 6/2010 | Pickard et al. | |
| 2010/0172122 | A1 | 7/2010 | Ramer et al. | |
| 2010/0187961 | A1 | 7/2010 | Scott | |
| 2010/0207502 | A1 * | 8/2010 | Cao et al. | 313/46 |
| 2010/0213808 | A1 | 8/2010 | Shi | |
| 2010/0219735 | A1 | 9/2010 | Sakai et al. | |
| 2010/0277059 | A1 | 11/2010 | Rains, Jr. et al. | |
| 2010/0277067 | A1 | 11/2010 | Maxik et al. | |
| 2010/0277069 | A1 | 11/2010 | Janik et al. | |
| 2010/0277907 | A1 | 11/2010 | Phipps et al. | |
| 2010/0301729 | A1 | 12/2010 | Simon et al. | |
| 2010/0314985 | A1 | 12/2010 | Premysler | |
| 2010/0315252 | A1 | 12/2010 | Desphande et al. | |
| 2011/0019409 | A1 | 1/2011 | Wronski | |
| 2011/0045614 | A1 | 2/2011 | Helbing et al. | |
| 2011/0051423 | A1 | 3/2011 | Hand et al. | |
| 2011/0095686 | A1 | 4/2011 | Falicoff et al. | |
| 2011/0176291 | A1 | 7/2011 | Sanders et al. | |
| 2011/0193473 | A1 | 8/2011 | Sanders et al. | |
| 2011/0215696 | A1 | 9/2011 | Tong et al. | |
| 2011/0278633 | A1 | 11/2011 | Clifford | |

OTHER PUBLICATIONS

NNCrystal Poster Displayed at LightFair 2010, May 10-14, 2010.
NNCrystal Corporation Handout at LightFair May 10-14, 2010.
Cree True White Light, 2011.
M. Lamonica, "Cree raises stakes in LED bulb race," CNET News, Jan. 27, 2011.
M. Lamonica, "Sylvania takes on 60-watt bulb with LED light," CNET News, May 13, 2010.
M. Lamonica, "GE makes LED replacement for 40-watt bulb," CNET News, Apr. 8, 2010.
C. Lombardi, "Philips offers LED replacement for 60-watt bulb," CNET News, May 12, 2010.
M. Lamonica, "LEDs keep coming: 60-watt stand-in priced at $30," CNET News, Dec. 13, 2010.
"Lighting Science Group Pursues Prestigious L Prize with Revolutionary New LED Bulb," Mar. 8, 2011.
United State Office Action issued in U.S. Appl. No. 13/051,596 dated Dec. 9, 2011.
United States Office Action issued in U.S. Appl. No. 13/051,662 dated Apr. 13, 2012.
United States Office Action issued in U.S. Appl. No. 13/051,596 dated May 30, 2012.
International Search Report and Written Opinion of the International Searching Authority issued in International Patent Application No. PCT/US12 /27862 dated Jul. 13, 2012.
International Search Report and Written Opinion of the International Searching Authority issued in International Patent Application No. PCT/US 12/27856 dated Jul. 13, 2012.
International Search Report and Written Opinion of the International Searching Authority issued in International Patent Application No. PCT/US 12/27869 dated Jul. 13, 2012.

* cited by examiner

SEMICONDUCTOR LAMP WITH THERMAL HANDLING SYSTEM

TECHNICAL FIELD

The present subject matter relates to lamps for general lighting applications that utilize solid state light emitting sources to effectively produce and distribute light of desirable characteristics such as may be comparable to common incandescent lamps, yet can effectively dissipate the heat generated by the solid state light emitting sources.

BACKGROUND

It has been recognized that incandescent lamps are a relatively inefficient light source. However, after more than a century of development and usage, they are cheap. Also, the public is quite familiar with the form factors and light output characteristics of such lamps. Fluorescent lamps have long been a more efficient alternative to incandescent lamps. For many years, fluorescent lamps were most commonly used in commercial settings. However, recently, compact fluorescent lamps have been developed as replacements for incandescent lamps. While more efficient than incandescent lamps, compact fluorescent lamps also have some drawbacks. For example, compact fluorescent lamps utilize mercury vapor and represent an environmental hazard if broken or at time of disposal. Cheaper versions of compact fluorescent lamps also do not provide as desirable a color characteristic of light output as traditional incandescent lamps and often differ extensively from traditional lamp form factors.

Recent years have seen a rapid expansion in the performance of solid state light emitting sources such as light emitting devices (LEDs). With improved performance, there has been an attendant expansion in the variety of applications for such devices. For example, rapid improvements in semiconductors and related manufacturing technologies are driving a trend in the lighting industry toward the use of light emitting diodes (LEDs) or other solid state light sources to produce light for general lighting applications to meet the need for more efficient lighting technologies and to address ever increasing costs of energy along with concerns about global warming due to consumption of fossil fuels to generate energy. LED solutions also are more environmentally friendly than competing technologies, such as compact fluorescent lamps, for replacements for traditional incandescent lamps. Hence, there are now a variety of products on the market and a wide range of published proposals for various types of lamps using solid state light emitting sources, as lamp replacement alternatives.

Increased output power of the solid state light emitting sources, however, increases the need to dissipate the heat generated by operation of the solid state light emitting sources. Although many different heat dissipation techniques have been developed, there is still room for further improvement for lamps for general lighting applications that utilize solid state light emitting sources, to effectively dissipate heat generated by operation of the solid state light emitting sources.

SUMMARY

The teachings herein provide further improvements over existing lamp lighting technologies for providing energy efficient light utilizing solid state light emitters. The lamp is structurally configured to effectively dissipate heat generated during operation of the solid state light emitting sources.

In one example, a lamp includes a bulb and solid state light emitters for emitting light, such that lamp output is at least substantially white. A lighting industry standard lamp base is included for providing electricity from a lamp socket. Circuitry is connected to receive electricity from the lamp base, for driving the solid state emitters to emit light. A thermal handling system of the lamp includes a heat sink and a thermal core made of a thermally conductive material. The thermal core is positioned in the interior of the bulb supporting the solid state light emitters. A thermal transfer element of the thermal handling system is coupled to the thermal core and the heat sink. The heat transfer element supports the thermal core, with the solid state emitters, within the interior of the bulb; and that element transfers heat generated by the solid state light emitters from the thermal core to the heat sink. In some of the examples, at least one of the solid state light emitters is supported on an end of the thermal core in such an orientation so that a principal direction of emission of light from the at least one solid state light emitter is substantially the same as or parallel with a longitudinal axis of the lamp. Two or more of the solid state light emitters are supported on one or more lateral surfaces of the thermal core in orientations so that principal directions of emission of light from the two or more solid state light emitters are radially outward from the thermal core in different radial directions. The exemplary emitter arrangements may provide an emission distribution that, when viewed through the bulb, appears similar to light from the filament of an incandescent lamp.

In another example, a lamp includes a bulb, a heat sink and solid state light emitters. The lamp output light is at least substantially white. A thermal transfer element includes a first section forming a pedestal extending into an interior of the bulb supporting the solid state light emitters. Two or more of the solid state light emitters are supported on the pedestal in orientations so that principal directions of emissions from the two or more solid state light emitters are outward in different directions. A second section of the thermal transfer element extending from the pedestal of the first section and forms a spiral in heat communicative contact with the heat sink. The lamp includes a lighting industry standard lamp base for providing electricity from a lamp socket; and circuitry is connected to receive electricity from the lamp base, for driving the solid state emitters to emit light.

The disclosure below also encompasses a thermal handling system for a lamp, to effectively dissipate heat from the solid state light emitters during operation thereof.

In one example of a thermal handling system, the system includes a heat sink including longitudinally arranged heat radiation fins each having a section extending radially outward and a flair section extending circumferentially away from the radially extending fin section. A thermal transfer element includes a first section for extension into an interior of a bulb of the lamp and a second section coupled in heat communicative contact with the heat sink. A multi-surfaced three-dimensional thermal core is attached to or integrated with, and thermally coupled to the first section of the thermal transfer element to form a pedestal. The pedestal supports at least some solid state light emitters of the lamp on surfaces of the core in orientations to emit light outward from the pedestal through a bulb of the lamp in different principal directions. The radially extending sections of the fins have angular separation from each other so as to allow at least some light emitted via the bulb of the lamp to pass through spaces between the fins.

Additional advantages and novel features will be set forth in part in the description which follows, and in part will become apparent to those skilled in the art upon examination of the following and the accompanying drawings or may be learned by production or operation of the examples. The advantages of the present teachings may be realized and attained by practice or use of various aspects of the methodologies, instrumentalities and combinations set forth in the detailed examples discussed below.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

The various examples of solid state lamps disclosed herein may be used in common lighting fixtures, floor lamps and table lamps, or the like, e.g. as replacements for incandescent or compact fluorescent lamps. Similarly, the various examples of thermal handling systems are applicable to solid state lamps intended for a variety of lighting applications. Reference now is made in detail to the examples illustrated in the accompanying drawings and discussed below.

Figure 1A:
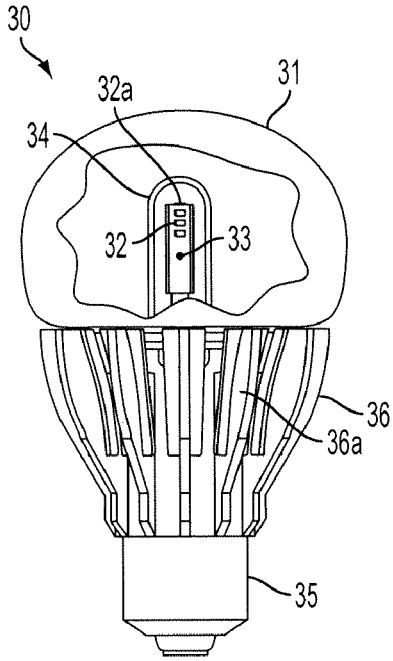
FIGS. 1A and 1B are side views of two somewhat similar examples of lamps (differing as to heat sink designs), for lighting applications, which use solid state light emitters to produce white light.
Figure 1B:
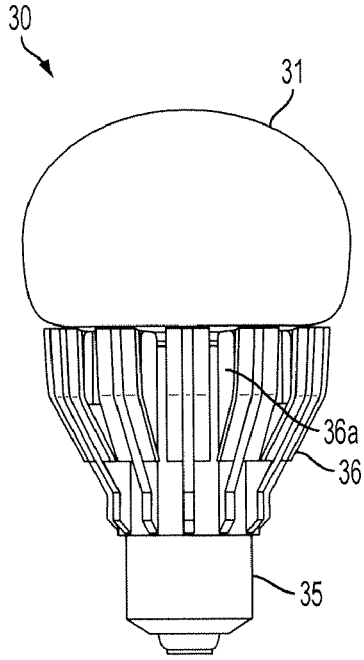

FIG. 1A illustrates an example of a solid state lamp 30. The exemplary lamp 30 may be utilized in a variety of lighting applications analogous to applications for common incandescent lamps and/or compact fluorescent lamps. The lamp 30 includes solid state light emitters 32 for producing lamp output light of a desired characteristic, from the emitter outputs and/or from luminescent phosphor emissions driven by the emitter outputs as discussed more fully below. The solid state emitters as well as the other components within the bulb 31 are visible through the cut-out window view of FIG. 1A. FIG. 1B is otherwise generally similar to FIG. 1A, minus the cut-out window, except that FIG. 1B also shows a somewhat different implementation of the heat radiation fin configuration of the heat sink.

At a high level, a lamp 30, includes solid state light emitters 32, a bulb 31 and a pedestal 33. The pedestal 33 extends into an interior of the bulb 31 and supports the solid state light emitters 32. In the examples, the orientations of the solid state light emitters 32 produce emissions through the bulb 31 that approximate light source emissions from a filament of an incandescent lamp. The examples also use an inner optical processing member 34, of a material that is at least partially light transmissive. The member 34 is positioned radially and longitudinally around the solid state light emitters 32 supported on the pedestal 33 and between an inner surface of the bulb 31 and the solid state light emitters 32. The bulb and/or the inner member may be transparent or diffusely transmissive.

Figure 2:
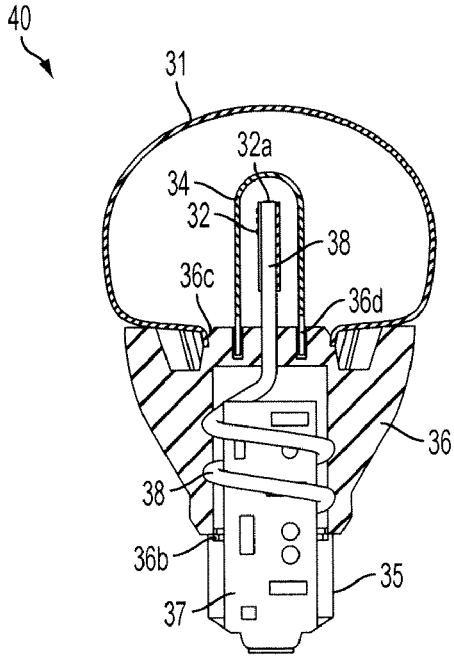
FIG. 2 is a cross-sectional view of an example of a lamp, for lighting applications, which uses solid state light emitters to produce white light.

With respect to the shape of the bulbs 31 in FIGS. 1A-2, the bulb and overall lamp shape, as well as the light output intensity distribution, correspond to current A-lamp parameters. Other bulb structures, however, may be used. Examples of other bulb structures include a globe-and-stem arrangement for a decorative globe type omni-directional lighting and R-lamp and Par-lamp style bulbs for different directed lighting applications. Some internal surfaces of the directional bulbs may be reflective, to promote the desired output distributions.

In any of the various shapes, the bulb 31 can be a diffusely transmissive or transparent glass or plastic bulb and exhibit a form factor within standard size, and the output distribution of light emitted via the bulb 31 conforms to industry accepted specifications, for a particular type of lamp product. Other appropriate transmissive materials may be used. For a diffuse outward appearance of the bulb, the output surface may be frosted white or translucent. Those skilled in the art will appreciate that these aspects of the lamp 30 facilitate use of the lamp as a replacement for existing lamps, such as incandescent lamps and compact fluorescent lamps.

The lamp 30 also includes a heat sink 36 (FIG. 1A) 36' (FIG. 1B). In these examples, the heat sinks are similar, but have somewhat different fin/flair arrangements. Alternative examples of heat sinks are shown in FIGS. 13A-14L and described in further detail below. In all examples, the heat sink has a modular-coupling for attachment of one of a number of different lighting industry standard lamp bases 35. The heat sink also has a second modular-coupling for attachment of one of a number of different types of bulbs 31. For examples that include the inner optical processing member 34, the heat sink also has a third modular-coupling for attachment of one of a number of different types of inner optical processing members 34. The base, heat sink and bulb also enclose circuitry connected to receive electricity from the lamp base 35, for driving the solid state emitters 32 of the source to emit the light. The modular couplings facilitate use of certain common components that form a light engine together with different bulbs, bases and/or inner optical processing members for different lamp configurations. The common components forming the engine may include the pedestal, the emitters and the heat sink.

In the examples, the pedestal 33 extends from the heat sink 36 or 36' along the central longitudinal axis of the light engine/lamp into a region to be surrounded by the bulb 31 when attached to the heat sink member at the first modular-coupling. The pedestal 33 provides heat conductivity to and is supported by the heat sink 36 or 36'.

In FIG. 1A, the fins 36*a* have an outward curved profile at their outer edges, The heat sink 36 also includes flares on the fins. In the example of FIG. 1A, the flares are located between the proximal and distal ends of the fins 36*a*, but the flares are longitudinally curved inward (as opposed to the outer curve at the perimeter of the fins). In a circumferential direction, the flairs also have inward curvature. In FIG. 1B, the fins 36*a'* have an angled outer profile at their outer edge. In the example of FIG. 1B, the flares are located at the distal ends of the fins; and in the longitudinal direction, the flares are angled to follow at least a substantial portion of the angled outer contour of the fins 36*a'*. In a circumferential direction, the flairs also have inward curvature. The lengths of the fins 36*a*/36*a'* longitudinally extend from the bulb 31 down to the base 35, although the flairs in these examples do not extend longitudinally down to the lamp base end of the heat sink, The radially extending sections of the fins have angular separation from each other so as to allow at least some light emitted via the bulb of the lamp to pass through spaces between the fins. Thus, light from the solid state emitters is dispersed upwards, laterally and downward, for example, for omni-directional lighting of a room from a table or floor lamp.

As shown in cross-section in FIG. 2, vertically positioned circuit board 37 is illustrated. The circuit board 37 is the circuitry provided for driving the plurality of solid state light emitters and is positioned inside the lamp base 35. In this example the circuit board 37 extends vertically upward from the base in an interior space within the heat sink 36. As shown in FIG. 2, the heat pipe 38 coils around a portion of the circuit board 37. The lamp 40 in FIG. 2 has a lighting industry standard lamp base 35 modularly connected to the heat sink 36 and electrically connected to provide alternating current electricity to the circuit board 37 for driving the solid state light emitters 32, 32*a* supported on the pedestal.

The examples also encompass heat dissipation technology to provide good heat conductivity so as to facilitate dissipation of heat generated during operation of the solid state light emitters 32. Hence, the exemplary lamp 30 in FIG. 1A-1B or 40 in FIG. 2 includes one or more elements forming a heat or thermal handling system for receiving heat produced by the solid state light emitters 32 and transferring that heat to a sink for dissipation to the ambient atmosphere. Active dissipation, passive dissipation or a combination thereof may be used, although the illustrated examples do not include an active heat dissipation component. In the examples, the thermal handling system includes the core formed on or attached to a portion of the heat pipe or other heat transfer element and a heat sink coupled to an opposite end of the heat transfer element. The fins 36*a*/36*a'* on the heat sink extend along the outside of the lamp between the bulb and the lamp base and include one or more openings or passages between the fins, for allowing flow of air, to dissipate heat from the fins 36*a*/36*a'* of the heat sink 36/36'. Air passages may also be provided through the coupling of the heat sink to the bulb and or to/from the interior of the inner optical processing member to allow flow of air around the emitters and venting thereof to the exterior of the lamp.

In FIG. 2, the heat pipe, or other type of heat transfer element, is provided to assist in the removal of heat generated by the solid state emitters 32 present on the pedestal. The heat pipe 38 is a heat transfer element that combines the principles of both thermal conductivity and phase transition to efficiently manage the transfer of heat. In FIG. 2, the heat is generated by the solid state light emitters near the end of the heat pipe inside the bulb generates heat. This heat should be effectively removed in order to prolong the operating life of the solid state emitters. At the hot interface within the heat pipe, a liquid contained within the heat pipe comes into contact with a thermally conductive solid surface adjacent to the solid state light emitters and turns into a vapor by absorbing heat from that surface. The vapor condenses back into a liquid at a cold interface away from the solid state light emitters, releasing the latent heat to the heat sink for dissipation through the fins to the air in the gaps between adjacent fins of the heat sink. The liquid then returns to the hot interface adjacent the light emitters through capillary action where it evaporates once more and repeats the cycle. In addition, the internal pressure of the heat pipe can be set or adjusted to facilitate the phase change depending on the demands of the working conditions of the lighting application of the lamp.

As noted earlier, a variety of multi-surfaced shapes may be used for a core to support one or more solid state light emitters. In the example shown in FIG. 2, the heat pipe end supporting the solid state light emitters 32 and positioned within the cavity of bulb 31, can be molded or shaped in a multi-surfaced three-dimensional core with three lateral surfaces to support the solid state light emitters 32. Although three surfaces are illustrated in this example, two or more lateral surfaces are sufficient for the multi-surfaced three-dimensional core. In this example, the heat pipe also integrates the core of the pedestal for supporting the solid state emitters.

In the example shown in FIG. 1A, the pedestal includes a multi-surfaced three-dimensional thermal core and an end of the heat pipe together providing the support for the solid state light emitters 32, and the multi-surfaced three-dimensional thermal core has three lateral surfaces (FIG. 5A) supporting solid state light emitters 32 and an end face supporting at least one solid state light emitter 32*a*. Although three surfaces are illustrated in this example, two or more lateral surfaces are sufficient for the multi-surfaced three-dimensional thermal core. As further shown in FIG. 2, circuitry in the form of circuit board 37, is at least partially enclosed by the heat sink connected to drive the solid state emitters 32 in response to electricity received from lamp base 35 when attached to the heat sink 36 at the first modular-coupling 36*b*.

Figure 12:
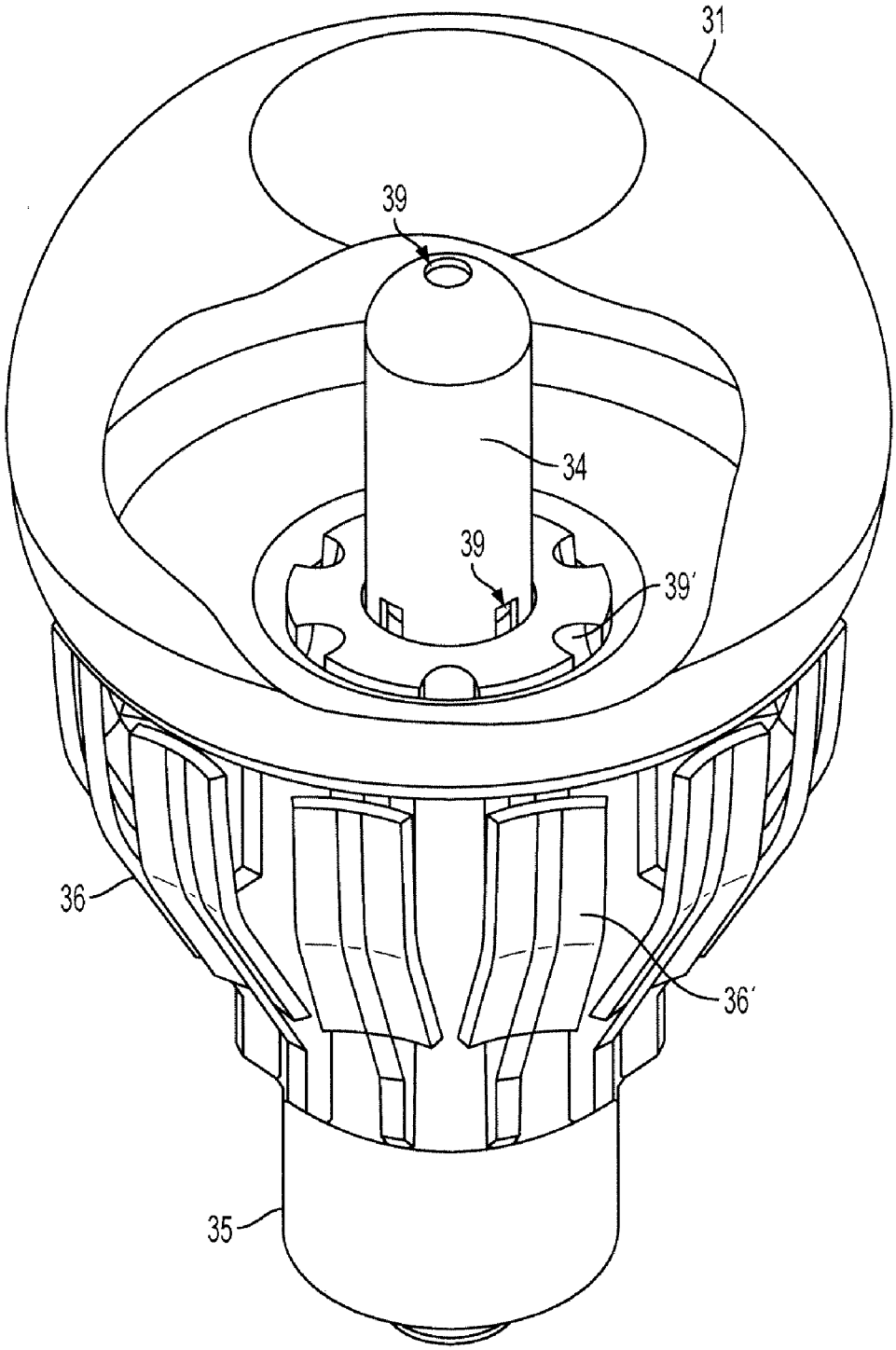
FIG. 12 is a side view of another lamp which uses solid state light emitters to produce white light which includes air passages to assist with heat dissipation.

The lamp shown in FIG. 12 is similar to the lamp illustrated in FIG. 2, but further includes air passages 39 and 39'. The inner optical processing member 34 can include air passages 39 in the upper and/or lower sections of the vertically positioned inner member 34. Air passages 39' are provided through the modular coupling of the heat sink 36 to the bulb 31 and/or to the interior of the inner optical processing member 34 to allow flow of air around the emitters and venting thereof to the exterior of the lamp. If a mesh material is used for the member, the porous nature of the mesh would allow heated air adjacent to the solid state emitters to escape to the interior of the bulb 31 and through air passages 39' in the heat sink 36 to the spacing between adjacent heat fins of the heat sink. The passages 39 allow airflow through the interior of the member 34 and around the solid state emitters. The passages 39' allow airflow from the interior of the bulb 31 to angled open areas between fins 36 of the heat sink. The position, number, shape and size of the air passages 39, 39' are purely illustrative and can be adjusted to effectively maximize heat dissipation from the interior of the bulb 31 to the exterior of the lamp.

In the exemplary orientation of FIG. 12, light emitted from the solid state emitters 32 is permitted to pass out upward and laterally through the bulb 31 and substantially downward between the spacing between adjacent fins. The radially extending sections of the fins have angular separation from each other so as to allow at least some light emitted via the bulb of the lamp to pass through spaces between the fins. Thus, light from the solid state emitters is dispersed upwards, laterally and downward, for example, for omni-directional lighting of a room from a table or floor lamp. The orientation shown, however, is purely illustrative. The lamp 30/40 may be oriented in any other direction appropriate for the desired lighting application, including downward, any sideways direction, various intermediate angles, etc.

The light output intensity distribution from the lamp corresponds at least substantially to that currently offered by A-lamps. Other bulb/container structures, however, may be used; and a few examples include a bulb-and-stem arrangement for a decorative globe lamp type omni-directional lighting, as well as R-lamp and Par-lamp style bulbs for different directed lighting applications. At least for some of the directed lighting implementations, some internal surfaces of the bulbs may be reflective, to promote the desired output distributions.

The modularity of the solid state lamp will now be described further with reference back to FIG. 2. The heat sink 36 includes a first modular-coupling 36*b* for attachment of one of the various different lighting industry standard lamp bases 35. The heat sink 36 also includes a second modular-coupling 36*c* for attachment of one of the different types of bulbs 31 each corresponding to a respective one of the applicable industry standard types of lamps. The heat sink 36 has an optional third modular-coupling 36*d* for attachment of one of a number of different types of light transmissive optical processing members 34 radially surrounding and spaced from the solid state light emitters 32. The optical processing member 34 may be transparent or diffusely transmissive, without phosphor. In most examples, however, the member 34 also serves as the carrier for providing remote deployment of a phosphor material to process light from the solid state emitters 32. Different phosphor mixtures or formulations, deployed by different members 34 enable different instances of the lamp to produce white light as an output of the lamp through the bulb at different color temperatures. Some different phosphor formulations also offer different spectral qualities of the white light output. Remote deployment of the phosphor(s) is discussed later.

As further shown in FIG. 2, the heat pipe 38 extends upward from the heat sink 36 along a longitudinal axis of the light engine into a region to be surrounded by the bulb 31 when attached to the heat sink 36 at the second modular-coupling 36*c*, the heat pipe 38 providing heat conductivity to and being supported by the heat sink 36. Multiple solid state light emitters 32 are supported on the heat pipe in orientations to emit light outward from the pedestal such that emissions from the solid state light emitters 32 through the bulb 31 when attached to the heat sink 36 approximate light source emissions from a filament of an incandescent lamp.

The modular coupling capability of the heat sink 36, together with the bulb and base that connect to the heat sink, provide a 'light engine' portion of the lamp for generating white light. Theoretically, the engine and bulb could be modular in design to allow a user to interchange glass bulbs, but in practice the lamp is an integral product. The light engine may be standardized across several different lamp product lines (A-lamps, R-lamps, Par-lamps or other styles of lamps, together with Edison lamp bases, three-way medium lamp bases, etc.). The modularity facilitates assembly of common elements forming the light engine together with the appropriate bulb and base (and possibly different drive circuits on the internal board), to adapt to different lamp applications/configurations.

As outlined earlier, the solid state lamps in the examples produce light that is at least substantially white. Although output of the light from the emitters may be used, the color temperature and/or spectral quality of the output light may be relatively low and less than desirable, particular for high end lighting applications. Thus, many of the examples add remote phosphor to improve the color temperature and/or spectral qualities of the white light output of the lamps.

As referenced above, the lamp described in certain examples will include or have associated therewith remote phosphor deployment. The phosphor(s) will be external to the solid state light emitters 32. As such, the phosphor(s) are located apart from the semiconductor chips of the solid state emitters used in the particular lamp, that is to say remotely deployed with respect to the solid state emitters. The phosphor(s) are of a type for converting at least some portion of light from the solid state light emitters from a first spectral characteristic to a second spectral characteristic, to produce a white light output of the lamp from the bulb.

As shown in FIGS. 1A-2, an inner optical processing member 34 remotely deploys the phosphor(s) with respect to the solid state light emitters 32. In conjunction with the phosphor bearing inner member 34, or as an alternative, the phosphor can be deployed on an inner surface of the bulb 31 facing the solid state light emitters. Although one or both may be transparent, the inner member 34 alone, or together with the bulb 31 can be transparent or diffusely transmissive.

For the lamp implementations with remotely deployed phosphor, the member and its support of the phosphor may take a variety of different forms. Solid examples of the member 34 may be transparent or diffusely transmissive. Glass, plastic and other materials are contemplated for the member 34. The phosphors may be embedded in the material of the member or may be coated on the inner surface and/or the outer surface of the member 34. The member may also allow air flow, for example, through passages (not shown). In another approach, the member 34 is formed of a permeable mesh coated with the phosphor material.

The inner member 34 of the examples shown in FIGS. 1A-2, is a cylinder and dome like structure. Those skilled in the art will recognize that other shapes may be used for the member, such as a globe on a stalk, a hemisphere or even multi-sided shapes like various polygon shapes. The inner member 34 of the examples shown in FIGS. 1A-2, is a cylinder and dome like structure. Those skilled in the art will recognize that other shapes may be used for the member, such as a globe on a stalk, a hemisphere or even multi-sided shapes like various polygon shapes. The inner member 34 is positioned around the solid state light emitters 32 and can include one or more remotely deployed phosphors. In a particular example, one or more semiconductor nanophosphors can be dispersed on the inner member, such as by spray coating (or other industry recognized phosphor application technique) of the one or more semiconductor nanophosphors with a carrier/binder on a transmissive or diffusely transmissive surface of the inner member 34.

The solid state lamps in the examples produce light that is at least substantially white. In some examples, the solid state emitters produce light that is at least substantially white. The white light from the emitters may form the lamp output. In other examples, the emitters produce white light at a first color temperature, and remotely deployed phosphor(s) in the lamp converts some of that light so that the lamp output is at least substantially white, but at a second color temperature. In these various examples, light is at least substantially white if human observers would typically perceive the light in question as white light.

It is contemplated that the lamp 30 may have a light output formed by only optical processing of the white light emitted by the solid state emitters 32. Hence, the white light output of the lamp 30 would be at least substantially white, in this case as white as the emitters are configured to produce; and that light would be at a particular color temperature. If included, the member 34 may provide diffusion, alone or in combination with diffusion by the bulb. Producing lamps of different color temperatures, using this approach would entail use of different white solid state emitters 32.

Another approach uses the emitters 32 that emit white light at the first color temperature in combination with a remotely deployed material bearing one or more phosphors. Semiconductor nanophosphors, doped semiconductor nanophosphors, as well as rare earth and other conventional phosphors, may be used alone or in various combinations to produce desired color temperatures and/or other desirable characteristics of a white light output. In this type arrangement, the phosphor or phosphors convert at least some portion of the white light (at a first color temperature) from the solid state light emitters from a first spectral characteristic to light of second spectral characteristic, which together with the rest of the light from the emitters produce the white light output from the bulb at a second color temperature.

In other examples the solid state light emitters 32 could be of any type rated to emit narrower band energy and remote phosphor luminescence converts that energy so as to produce a white light output of the lamp. In the more specific examples using this type of phosphor conversion, the light emitters 32 are devices rated to emit energy of any of the wavelengths from the blue/green region around 460 nm down into the UV range below 380 nm. In some examples, the solid state light emitters 32 are rated for blue light emission, such as at or about 450 nm. In other examples, the solid state light emitters 32 are near UV LEDs rated for emission somewhere in the below 420 nm, such as at or about 405 nm. In these examples, the phosphor bearing material may use a combination of semiconductor nanophosphors, a combination of one or more nanophosphors with at least one rare earth phosphor or a combination in which one or more of the phosphors is a doped semiconductor nanophosphor.

Many solid state light emitters exhibit emission spectra having a relatively narrow peak at a predominant wavelength, although some such devices may have a number of peaks in their emission spectra. Often, manufacturers rate such devices with respect to the intended wavelength $\lambda$ of the predominant peak, although there is some variation or tolerance around the rated value, from device to device. Solid state light emitters for use in certain exemplary lamps will have a predominant wavelength $\lambda$ in the range at or below 460 nm ($\lambda \leqq 460$ nm), such as in a range of 380-460 nm. In lamps using this type of emitters, the emission spectrum of the solid state light emitter will be within the absorption spectrum of each of the one or more remotely deployed phosphors used in the lamp.

Each phosphor or nanophosphor is of a type for converting at least some portion of the wavelength range from the solid state emitters to a different range of wavelengths. The combined emissions of the pumped phosphors alone or in combination with some portion of remaining light from the emitters results in a light output that is at least substantially white, is at a desired color temperature and may exhibit other desired white light characteristics. In several examples offering particularly high spectral white light quality, the substantially white light corresponds to a point on the black body radiation spectrum. In such cases, the visible light output of the lamp deviates no more than ±50% from a black body radiation spectrum for the rated color temperature for the device, over at least 210 nm of the visible light spectrum. Also, the visible light output of the device has an average absolute value of deviation of no more than 15% from the black body radiation spectrum for the rated color temperature for the device, over at least the 210 nm of the visible light spectrum.

Whether using white light emitters or emitters of energy of wavelengths from the blue/green region around 460 nm down into the UV range below 380 nm, the implementations using phosphors can use different phosphor combinations/mixtures to produce lamps with white light output at different color temperatures and/or of different spectral quality.

If included, the phosphor(s) is remotely deployed in the lamp, relative to the emitters. A variety of remote phosphor deployment techniques may be used. For example, the phosphors may be in a gas or liquid container between the bulb 31 and the member 34. The phosphor(s) may be coated on the inner surface of the bulb 31. However, the member 34 also offers an advantageous mechanism for remotely deploying the phosphor(s). In many examples, the phosphor(s) may be embedded in the material of the member 34 or coated on an inner and/or an outer surface of the member.

As outlined above, the solid state light emitters 32 are semiconductor based structures for emitting light, in some examples for emitting substantially white light and in other examples for emitting light of color in a range to pump phosphors. In the example, the light emitters 32 comprise light emitting diode (LED) devices, although other semiconductor devices might be used.

As discussed herein, applicable solid state light emitters essentially include any of a wide range light emitting or generating devices formed from organic or inorganic semiconductor materials. Examples of solid state light emitters include semiconductor laser devices and the like. Many common examples of solid state emitters, however, are classified as types of "light emitting diodes" or "LEDs." This exemplary class of solid state light emitters encompasses any and all types of semiconductor diode devices that are capable of receiving an electrical signal and producing a responsive output of electromagnetic energy. Thus, the term "LED" should be understood to include light emitting diodes of all types, light emitting polymers, organic diodes, and the like. LEDs may be individually packaged, as in the illustrated examples. Of course, LED based devices may be used that include a plurality of LEDs within one package, for example, multi-die LEDs that contain separately controllable red (R), green (G) and blue (B) LEDs within one package. Those skilled in the art will recognize that "LED" terminology does not restrict the source to any particular type of package for the LED type source. Such terms encompass LED devices that may be packaged or non-packaged, chip on board LEDs, surface mount LEDs, and any other configuration of the semiconductor diode device that emits light. Solid state lighting elements may include one or more phosphors and/or nanophosphors, which are integrated into elements of the package to convert at least some radiant energy to a different more desirable wavelength or range of wavelengths.

Attention is now directed to the lamp base which is modularly connected to the heat sink. The lamp base 35 (FIGS. 1A-2) may be any common standard type of lamp base, to permit use of the lamp 30/40 in a particular type of lamp socket. The lamp base 35 may have electrical connections for a single intensity setting or additional contacts in support of three-way intensity setting/dimming. Common examples of lamp bases include an Edison base, a mogul base, a candelabra base and a bi-pin base. It is understood that an adaptor (intermediate to the base 35 and heat sink 36) can be used to accommodate the different sizes of standard lamp bases for attachment at the modular coupling on the heat sink of the lamp 30. For simplicity, two examples of lamp bases are shown in FIGS. 3 and 4.

Figure 3:
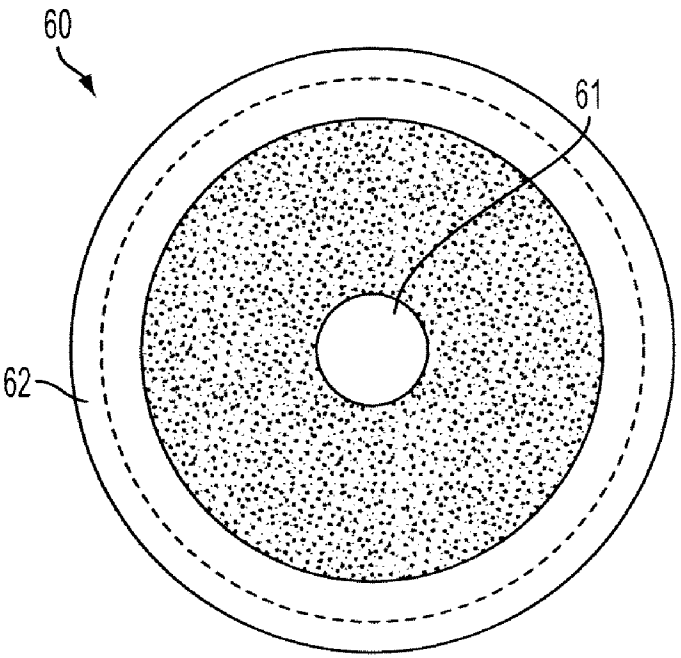
FIG. 3 is a plan view of a screw type lamp base, such as an Edison base or a candelabra base.

FIG. 3 is a plan view of a screw type lamp base, such as an Edison base or a candelabra base. For many lamp applications, the existing lamp socket provides two electrical connections for AC main power. The lamp base in turn is configured to mate with those electrical connections. FIG. 3 is a plan view of a two connection screw type lamp base 60, such as an Edison base or a candelabra base. As shown, the base 60 has a center contact tip 61 for connection to one of the AC main lines. The threaded screw section of the base 60 is formed of metal and provides a second outer AC contact at 62, sometimes referred to as neutral or ground because it is the outer casing element. The tip 61 and screw thread contact 62 are separated by an insulator region (shown in gray).

Figure 4:
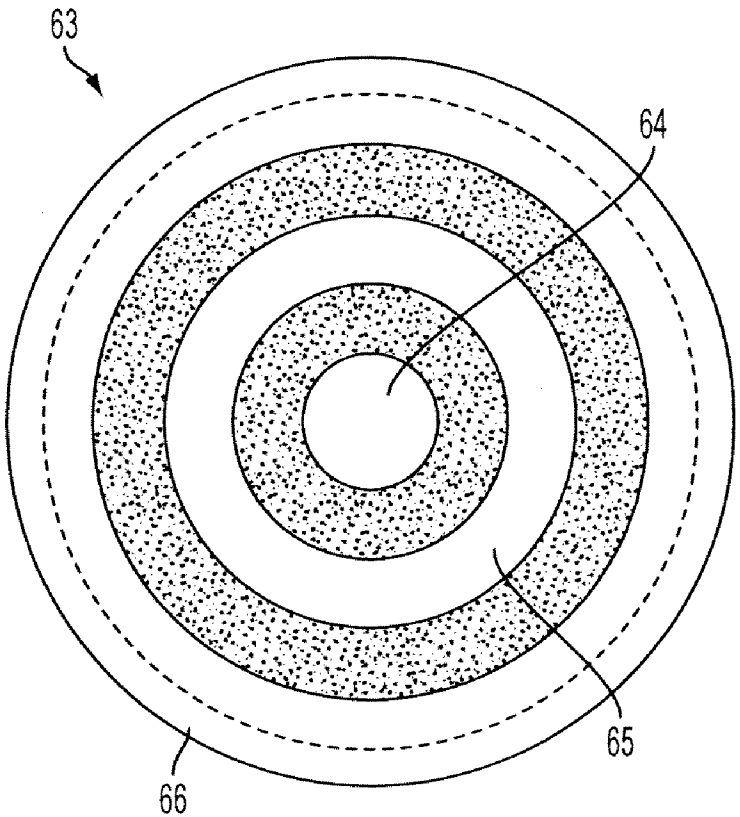
FIG. 4 is a plan view of a three-way dimming screw type lamp base, such as for a three-way mogul lamp base or a three-way medium lamp base.

FIG. 4 is a plan view of a three-way dimming screw type lamp base, such as for a three-way mogul lamp base or a three-way medium lamp base. Although other base configurations are possible, the example is that for a screw-in base 63 as might be used in a three-way mogul lamp or a three-way medium lamp base. As shown, the base 63 has a center contact tip 64 for a low power connection to one of the AC main lines. The three-way base 63 also has a lamp socket ring connector 65 separated from the tip 64 by an insulator region (shown in gray). A threaded screw section of the base 63 is formed of metal and provides a second outer AC contact at 66, sometimes referred to as neutral or ground because it is the outer casing element. The socket ring connector 65 and the screw thread contact 66 are separated by an insulator region (shown in gray).

Many of the components, in the form of a light engine, can be shared between different types/configurations of lamps. For example, the heat sink and pedestal may be the same for an Edison mount A lamp and for three-way A lamp. The lamp bases would be different. The drive circuitry would be different, and possibly the number and/or rated output of the emitters may be different.

The solid state light emitters in the various exemplary lamps may be driven/controlled by a variety of different types of circuits. Depending on the type of solid state emitters selected for use in a particular lamp product design, the solid state emitters may be driven by AC current, typically rectified; or the solid state emitters may be driven by a DC current after rectification and regulation. The degree of control may be relatively simple, e.g. ON/OFF in response to a switch, or the circuitry may utilize a programmable digital controller, to offer a range of sophisticated options. Intermediate levels of sophistication of the circuitry and attendant control are also possible.

A more detailed explanation of the solid state emitters and their arrangement in the lamp is now provided. The solid state light emitters 32 are positioned on the pedestal 33 positioned inside bulb 31. The pedestal 33 extends into the interior of the bulb 31 supporting the solid state light emitters in orientations such that emissions from the solid state light emitters 32 through the bulb 31 approximate light source emissions from a filament of an incandescent lamp. The pedestal 33 includes a multi-surfaced three-dimensional thermal core (discussed in further detail below in regard to FIGS. 5A-5D) that provides support for the solid state light emitters 32 in the interior of the bulb 31.

The pedestal 33 supports the solid state emitters 32 by way of a multi-surfaced three-dimensional thermal core providing the support for the solid state light emitters in the interior of the bulb 31. A variety of multi-surfaced shapes may be used for a thermal core to support one or more solid state light emitters. The multi-surfaced three-dimensional thermal core is made of a durable heat conducting material such as copper (Cu), aluminum (Al), thermally conductive plastics or ceramics. An example of a ceramic material is commercially available from CeramTec GmbH of Plochingen, Germany. Composite structures, having a conductive outer material and graphite core or a metal core with an outer dielectric layer are also contemplated. In some cases, the emitters are mounted on a circuit board attached to the core, whereas in other examples, electrical traces for the circuitry may be integrated with the core and the emitters mounted directly to the core without use of an additional circuit board element. Different materials may be selected for the core as a trade off of manufacturing cost/complexity versus effective heat transfer.

Figure 5A:
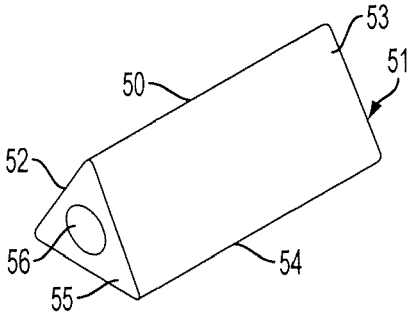
FIG. 5A is a perspective view of the multi-surfaced three-dimensional thermal core.
Figure 5B:
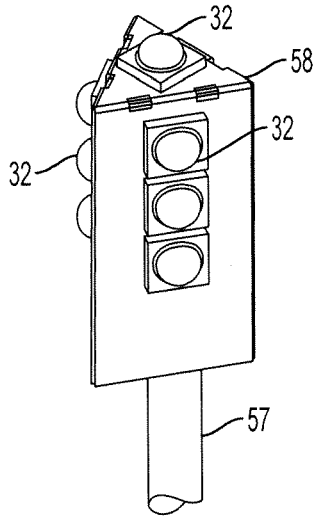
FIG. 5B is a perspective view of the multi-surfaced three-dimensional thermal core on which the solid state light emitters are supported on the core and a portion of a heat transfer element extending from a lower surface of the core.
Figure 5C:
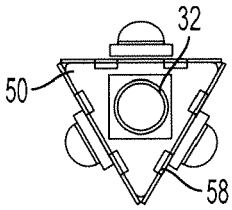
FIGS. 5C and 5D are top and bottom views of the multi-surfaced three-dimensional thermal core and emitters of FIG. 5B.
Figure 5D:
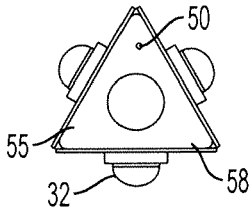

As shown in the example of FIG. 5A, the multi-surfaced three-dimensional thermal core 50 has three lateral surfaces 52, 53, 54 for supporting the solid state light emitters. In the example, the core includes an end face 51 which may or may not support one or more solid state light emitters. Of course, the core may have fewer or more lateral and/or end surfaces for supporting the solid state emitter for outward emission. Also, the example uses a number of emitters, although it may be possible to use as few as one emitter. In FIG. 5B, the solid state light emitters 32 are supported on the three-dimensional thermal core 50. In the example of FIG. 5B, three packaged LEDs are present on each of the lateral surfaces 52, 53, 54, and one LED appears on end face 51. FIGS. 5C and 5D are top and bottom views of the core, LEDs etc. of FIG. 5B.

In addition to the core 51, the pedestal in the example of FIG. 5B includes a portion of a heat transfer element, represented by a heat pipe 57. Those skilled in the art will appreciate that other heat transfer elements may be used in place of the heat pipe 57, depending on cost/performance considerations. The heat pipe 57 extends from the heat sink along a longitudinal axis of the light engine/lamp into a region surrounded by the bulb. The heat pipe 57 is attached to the heat sink member so as to support the core 51 and thus support the solid state light emitters 32.

In this example, the core 50 is attached to a section of the heat pipe 57 to form the pedestal, although in some later examples, the core is an integral element of the pedestal section of the heat pipe or other type of heat transfer element. Thus, the core and heat transfer element may be formed as an integral member or as two separate elements joined or attached together. As shown in FIG. 5A, end face 55 therefore includes opening 56 for insertion of the heat pipe 57 into the core. A coupling with good heat transfer is provided in one of several ways. For example, a thermal adhesive may be provided, the core may soldered onto the heat pipe 57, or the core may be pressed or heat shrink fitted onto the axially extending section of the heat pipe 57.

Figure 5E:
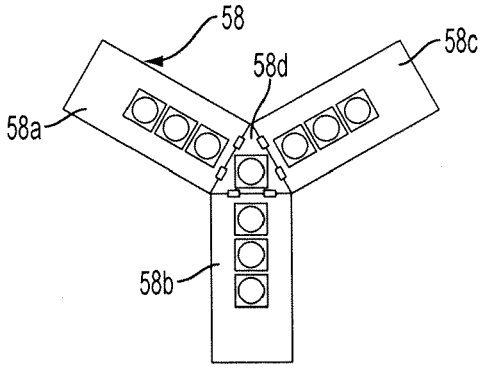
FIG. 5E is a top view of a flexible printed circuit board including the solid state light emitters.
Figure 5F:
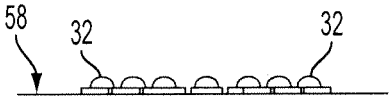
FIG. 5F is a side view of the flexible printed circuit board including the solid state light emitters.
Figure 5G:
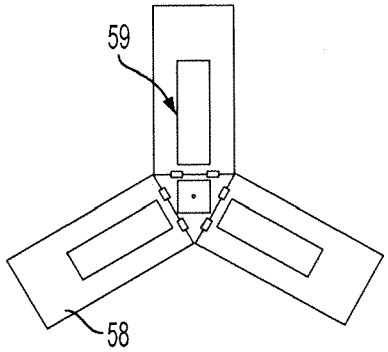
FIG. 5G is a bottom view of a flexible printed circuit board including thermal pads or exposed solid state light emitter heat sinks.

FIG. 5E is a top view of a flexible printed circuit board 58, showing the solid state light emitters positioned on three tabs 58*a*, 58*b*, 58*c* of the flexible circuit board 58 and a single solid state light emitter on center section 58*d*. FIG. 5F is a side view of the flexible primed circuit board 58 including the solid state light emitters 32. FIG. 5G is a bottom view of a flexible printed circuit board 58 including thermal pads or exposed solid state light emitter heat sinks. The circuit board may be rigid with flexibly connected tabs, the entire board may be flexible or some or all of the board may be bendable (e.g. with a bendable metal core).

In the example shown in FIG. 5E, the solid state emitters 32 are mounted on various linked sections of the one flexible circuit board 58. The flexible circuit board is fixedly secured to multi-surfaced three-dimensional thermal core 50 by way of flexible tabs 58*a*, 58*b*, 58*c* on which the solid state emitters 32 are mounted. When installed on the multi-surfaced three-dimensional thermal core 50, each of tabs 58*a*, 58*b*, 58*c* can be bent to allow the tabs 58*a*, 58*b*, 58*c* to be fixedly secured to the lateral side surfaces 52, 53, 54 of the multi-surfaced three-dimensional thermal core 50 by way of solder or a thermally conductive adhesive. End face 58*d* of the flexible circuit board 58 includes a single solid state emitters 32 and is fixedly secured to end face 51 of the multi-surfaced three-dimensional thermal core 50 by way of solder or a thermally conductive adhesive.

The printed circuit board and emitters may be attached to the faces of the core by an adhesive or a solder. If solder is used, the solder to first attach the emitters to the board may melt at a higher temperature than the solder used to attach the board to the core, to facilitate assembly.

The example in FIGS. 5B-5C shows one emitter on the end face and three emitters on each of the lateral surfaces of the core, with the emitters on each lateral surface arranged in a line approximately parallel to the central longitudinal axis of the core/pipe/engine/lamp. Those skilled in the art will recognize that there may be different numbers of emitters on the end face and/or on any or all of the different lateral surfaces. Also, on any face or surface having a number of emitters, the emitters may be arranged in a different pattern than that shown, for example, so as to adapt emitters in a different type of package or having a different individual output pattern can be arranged such that emissions from the solid state light emitters through the bulb sufficiently approximate light source emissions from a filament of an incandescent lamp. As shown in FIG. 5E, center tab 58*d* of the flexible circuit board 58 is connected to each of tabs 58*a*, 58*b*, 58*c*.

Figure 6A:
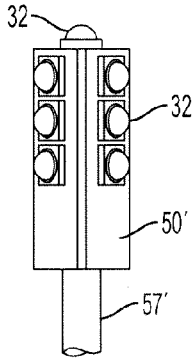
FIGS. 6A and 6B are perspective views of a multi-surfaced solid printed circuit board core on which packaged solid light emitters are supported and a portion of a heat transfer element extending from a lower surface of the thermal core.
Figure 6B:
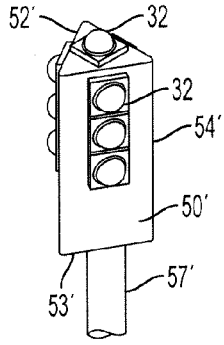
Figure 6C:
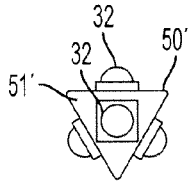
FIGS. 6C and 6D are top and bottom views of the core and emitters of FIG. 6A.
Figure 6D:
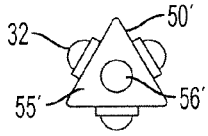

An alternative example for including the solid state light emitters on a thermal core is illustrated in FIGS. 6A-6D. In the example, solid state light emitters 32, such as packaged LEDs, are positioned on a multi-surfaced three-dimensional solid printed circuit board core 50'. The material of the core also carries or incorporates the conductors for the electrical connections to the various solid state light emitters. In examples where the circuitry is formed integrally with the core, the thermal core circuit board 50' can be a ceramic material or thermally conductive plastic material with electrical traces, or a metallic core with a dielectric layer and traces. The pedestal supports the solid state emitters 32 by way of the thermal core circuit board 50' providing the support for the solid state light emitters 32 in the interior of the bulb 31. As shown in FIG. 6B, the thermal core circuit board 50' has three lateral surfaces 52', 53', 54' for supporting the solid state light emitters 32; and an end face 51' (FIG. 6C) for supporting at least one solid state light emitter. In the example shown in FIGS. 6A-6B, three packaged LEDs are present on each of the lateral surfaces 52', 53', 54', and one LED appears on end face 51'. FIGS. 6C and 6D are top and bottom views of the thermal core circuit board 50', LEDs etc. of FIG. 6A.

In addition to the thermal core circuit board 50', the pedestal in the example of FIGS. 6A-6B includes a heat/thermal transfer element, represented by a heat pipe 57'. Those skilled in the art will appreciate that other transfer elements may be used in place of the heat pipe 57', depending on cost/performance considerations. The heat pipe 57' extends from the heat sink along a longitudinal axis of the light engine/lamp into a region surrounded by the bulb. The heat pipe is attached to the heat sink member so as to support the core and thus support the solid state light emitters. As shown in FIG. 6D, end face 55' includes opening 56' for insertion of the heat pipe 57' into the thermal core circuit board 50'. A coupling with good heat transfer is provided in one of several ways. For example, the thermal adhesive may be provided, the core may soldered onto the heat pipe 57', or the core may be pressed or heat shrink fitted onto the heat pipe 57'.

In some examples of the structures that provide thermal transfer as well as circuit connections, similar materials/structures may be used as the heat transfer element instead of the heat pipe. In such cases, it may be advantageous to manufacture the core and the heat transfer element as a single integral unit.

Figure 7A:
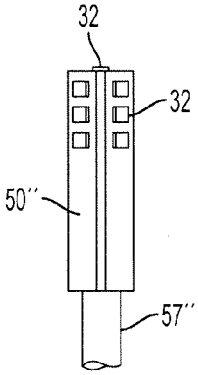
FIGS. 7A and 7B are perspective views of a multi-surfaced solid printed circuit board core on which light emitting diode dies are supported and a portion of a heat transfer element extending from a lower surface of the core.
Figure 7B:
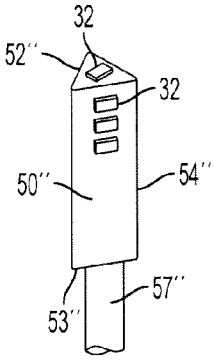
Figure 7C:
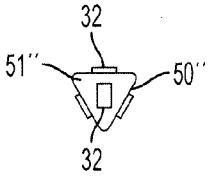
FIGS. 7C and 7D are top and bottom views of the core and emitters of FIG. 7A.
Figure 7D:
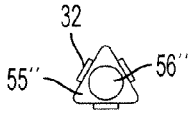

In yet another example shown in FIGS. 7A-7D, light emitting diode dies 32 can be positioned on a multi-surfaced three-dimensional solid printed circuit board core 50". The thermal core that incorporates the electrical conductors, circuit board 50" in the example can be a ceramic material or thermally conductive plastic material with electrical traces, or a metallic core with a dielectric layer and traces similar to the material of core 50' in the preceding example. The pedestal supports the dies 32 by way of thermal core circuit board 50" providing the support for the dies 32 in the interior of the bulb 31. As shown in FIG. 7B, the thermal core circuit board 50" has at least three lateral surfaces 52", 53", 54" for supporting the dies 32; and an end face 51" (FIG. 7C) for supporting at least one die 32. In the example of FIGS. 7A-7B, three dies are present on each of the lateral surfaces 52", 53", 54", and one die appears on end face 51". FIGS. 7C and 7D are top and bottom views of the thermal core circuit board 50", dies etc. of FIG. 7A.

In addition to the thermal core circuit board 50", the pedestal in the example of FIGS. 7A-7B includes a heat transfer element, represented by a heat pipe 57". Those skilled in the art will appreciate that other transfer elements may be used in place of the heat pipe 57", depending on cost/performance considerations, and in some constructions the element and the core may be part of an integral unit. The heat pipe 57" extends from the heat sink along a longitudinal axis of the light engine/lamp into a region surrounded by the bulb. The heat pipe is attached to the heat sink member so as to support the core and thus support the solid state light emitters. As shown in FIG. 7D, end face 55" includes opening 56" for insertion of the heat pipe 57" into the thermal core circuit board 50". A coupling with good heat transfer is provided in one of several ways. A thermal adhesive may be provided, the core may soldered onto the heat pipe 57", or the core may be pressed or heat shrink fitted onto the heat pipe 57".

In yet another example shown in FIGS. 7E-7I, circuit traces 71 and thermal pads 71' are applied directly to a multi-surfaced three-dimensional thermal core 70. The thermal core 70 in this example can be metallic, a ceramic material or plastic material with electrical traces 71 and thermal pads 71' applied directly to the core 70. In this example, the multi-surfaced three-dimensional thermal core 70 includes three lateral surfaces 73, 74, 75 for the solid state emitters to be mounted. Also included are corners 76, 77, 78 dispersed between the lateral faces 73, 74, 75. Thus, in this example, the core 70 includes a total of six lateral faces, three of which are reserved for the solid state emitters.

Figure 7E:
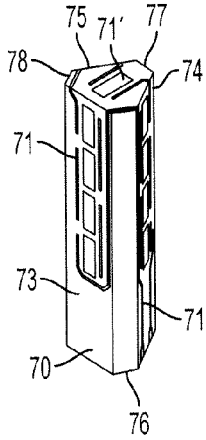
FIG. 7E is a perspective view of another example of a multi-surfaced three-dimensional thermal core.
Figure 7F:
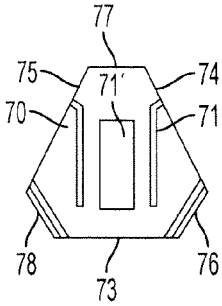
FIGS. 7F and 7G are top and bottom views of the core in FIG. 7E.
Figure 7G:
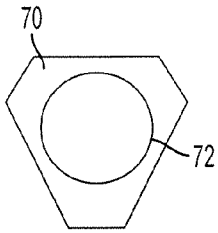
Figure 7H:
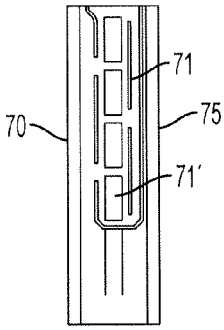
FIGS. 7H and 7I are side views of the core in FIG. 7E.
Figure 7I:
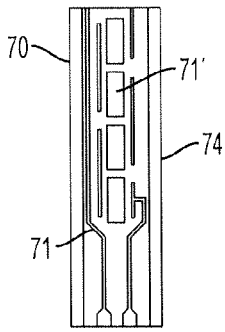

FIGS. 7F and 7G are top and bottom views of the thermal core 70 of FIG. 7E. In FIG. 7G, an opening 72 is included for the inclusion of the thermal transfer element such as a heat pipe (not shown). A coupling with good heat transfer is provided in one of several ways. A thermal adhesive may be provided, the core 70 may be soldered onto the heat pipe, or the core 70 may be pressed or heat shrink fitted onto the heat pipe. FIGS. 7H and 7I are side views of the lateral faces 75 and 74 of thermal core 70 and traces 71 and thermal pads 71' shown in FIG. 7E. In this example, the electrical traces 71 and thermal pads 71' for the circuitry are integrated with the core 70 and the emitters (not shown) are mounted directly to the core 70 without use of an additional circuit board element as described in some of the other examples.

Figure 8A:
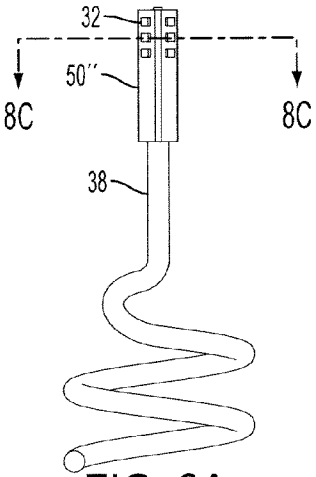
FIG. 8A is a perspective view of a thermal core circuit board on which light emitters are supported on the thermal core circuit board and the heat transfer element extending from a lower surface of the core.
Figure 8B:
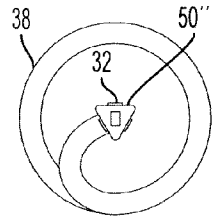
FIG. 8B is a top view of the heat transfer element, core and emitters of FIG. 8A.
Figure 8C:
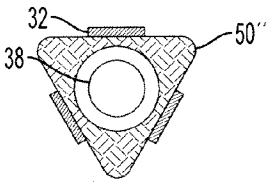
FIG. 8C is a section view of the core shown in FIG. 8A.

FIGS. 8A-8C are additional views of the thermal core circuit board 50" and dies 32 described above for FIGS. 7A-7D, although several of the views also illustrate different heat pipe configurations. FIG. 8A shows a spiral shape for the lower portion of the heat pipe which would otherwise be positioned in the heat sink 36 (FIG. 2) is shown. The upper vertical portion of the heat pipe extending into the inner region of bulb 31 is shown. This vertically extending portion of the heat pipe extends into an opening in an end face of the thermal core circuit board core 50". FIG. 8B is a top view of the core, emitters and thermal transfer element illustrated in FIG. 8A, and demonstrates that the core 50" is substantially centered within the spiral shape of the lower end of heat pipe 38. FIG. 8C is a sectional view taken along line A-A in FIG. 8A. The outer wall of the heat pipe 38 is fixedly positioned within the opening of the core 50". The heat pipe extends substantially the entire length of the core to maximize thermal dissipation of each of the dies 32 supported by the core during operation of the dies. The spiral shape of the heat pipe extends down in the heat sink section to effectively remove heat from the lamp. The spiral shape also allows for the circuitry to be included within the inner region of the spiral (FIG. 2).

Figure 9A:
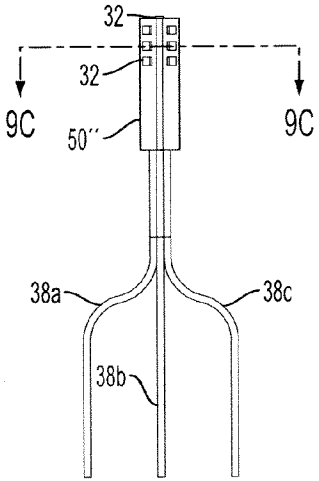
FIG. 9A is a perspective view of a thermal core circuit board on which light emitters are supported on the thermal core circuit board and a second example of the heat transfer element extending from a lower surface of the core.
Figure 9B:
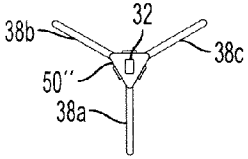
FIG. 9B is a top view of the heat transfer element, core and emitters of FIG. 9A.
Figure 9C:
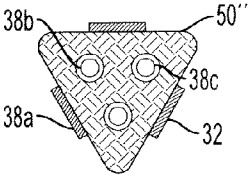
FIG. 9C is a section view of the core shown in FIG. 9A.

FIGS. 9A-9C illustrate an alternative shape for the heat pipe 38. In this example, the heat pipe comprises three individual heat pipe portions 38*a*, 38, 38*c*. The upper region of the heat pipe extending inside the opening of the thermal core 50" includes near-axial extensions of the three individual heat pipe portions 38*a*, 38, 38*c* in close proximity to one another, for example, positioned in a triangular shaped pattern around the core axis (FIG. 9C) where the pipes extend into and connect with the core. FIG. 9C is a section view taken along line B-B in FIG. 9A. The lower portion of the heat pipe 38, as shown in FIG. 9A, illustrates the separation of the individual heat pipe portions 38*a*, 38, 38*c* within the heat sink region. FIG. 9B is a top view of the core illustrated in FIG. 9A and shows that the individual heat pipe portions 38*a*, 38, 38*c* form legs that are spaced apart from one another at approximately 120° increments when positioned within the heat sink region. In the example, each heat pipe leg is spaced apart from, but generally parallel to, the central longitudinal axis of the core and the heat transfer element. Those skilled in the art will appreciate that the legs may have other shapes or angular arrangements, e.g. curved or spiral shaped. Also, the example shows three pipes/legs, but there may be two, or there may be more than three.

The heat pipe arrangements of FIGS. 8 and 9 are shown with the chip-on-board and integral core/circuit board arrangement like in FIGS. 7A-7D. Those skilled in the art will appreciate that similar heat pipe arrangements also may be used with the core and LED arrangements like those of FIGS. 5 and 6.

Figure 10A:
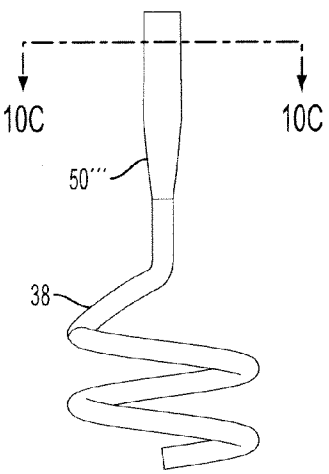
FIG. 10A is a perspective view of the heat transfer element including a molded/shaped multi-surfaced upper portion for supporting solid state light emitters and a spiral shaped lower portion.
Figure 10B:
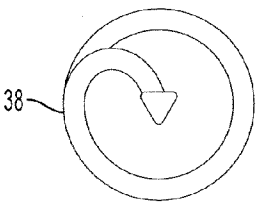
FIGS. 10B and 10C are top and section views of the heat transfer element of FIG. 10A.
Figure 10C:
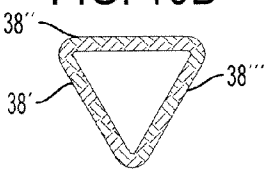

As discussed above for FIG. 2, the heat pipe can be molded or shaped into a thermal transfer element with two or more lateral surfaces in a first upper section to support the solid state light emitters 32. The heat pipe, in addition to its thermal dissipation role, also integrates the core of the pedestal for supporting the solid state emitters. FIGS. 10A-10C provide additional views of this configuration of the heat pipe, otherwise described above for FIG. 2, but without the solid state light emitters shown. The heat pipe end 50'" that supports the solid state light emitters is positioned within the cavity of bulb 31, and the pedestal section of the pipe can be molded or shaped to form an integral multi-surfaced thermal transfer core with at least three lateral surfaces 38', 38", 38'" to support the solid state light emitters 32. As shown in FIG. 10C, which illustrate a view along the F-F line of FIG. 10A, the three lateral surfaces 38', 38", 38'" of the first upper part of the heat pipe form a triangular shaped structure. FIG. 10B is a top view of the what is illustrated in FIG. 10A, demonstrating that the upper portion of the heat pipe that supports the solid state emitters is substantially centered within the spiral shape of the lower end of heat pipe 38.

Figure 11A:
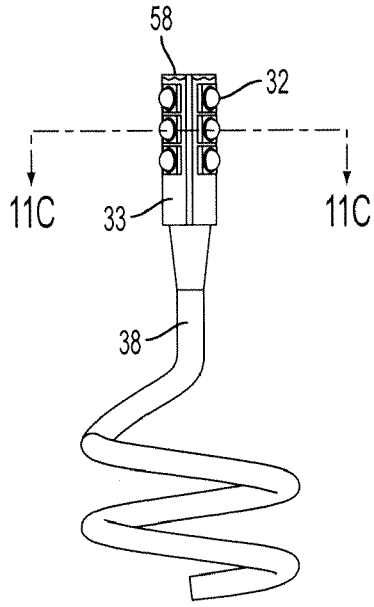
FIG. 11A a perspective view of the heat transfer element on which the solid state light emitters are supported by way of a flexible circuit board and a spiral shaped lower portion.
Figure 11B:
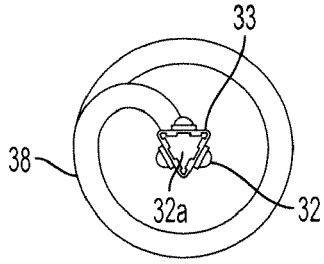
FIGS. 11B and 11C are top and section views of the core of FIG. 11A.
Figure 11C:
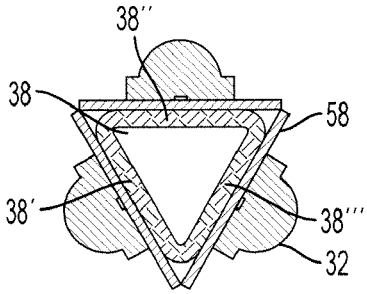

FIGS. 11A-11C illustrate a flexible circuit board 58 mounted directly on the heat transfer element 38, such as a heat pipe, which has been molded or shaped in a multi-surfaced three-dimensional core with at least three lateral surfaces 38', 38" and 38'" that support the flexible circuit board 58 including the solid state light emitters 32. Thus, FIGS. 11A-11C are similar to FIGS. 10A-10C described above, but also show the flexible circuit board being mounted directly on the three lateral surfaces 38', 38" and 38''' of the multi-surfaced three-dimensional core 38. FIG. 11B is a top view of what is illustrated in FIG. 11A, demonstrating that the upper portion of the heat pipe that supports the flexible circuit board and solid state emitters is substantially centered within the spiral shape of the lower end of heat pipe 38. As shown in FIG. 11C, which illustrate a sectional view along the C-C line of FIG. 11A, the three lateral surfaces 38', 38", 38''' of the heat pipe form a triangular shaped structure. The flexible circuit board 58 is soldered or otherwise bonded directly to the molded/shaped end of the multi-surfaced three-dimensional core 38. A single solid state emitter 32*a* is positioned on a surface of the circuit board on the end surface of the heat pipe (e.g. similar to the arrangement in FIGS. 5B and 5C). The spiral shape of the heat pipe extends down in the heat sink section to effectively remove heat from the lamp. The spiral shape also allows for the circuitry to be included within the inner region of the spiral, as shown in FIG. 2.

The core receives heat from the solid state emitters and carries the heat to the thermal transfer element. That element in turn carries the heat to the heat sink for dissipation to the ambient atmosphere. Examples of the core and transfer element have been shown and described. A variety of heat sink arrangements may be used.

A thermal handling system for any of the preceding lamps is now described. The system effectively dissipates heat from the solid state light emitters during operation thereof. In one example of a thermal handling system, the system includes a heat sink including longitudinally arranged heat radiation fins each having a section extending radially outward and a flair section extending circumferentially away from the radially extending fin section. Any of the examples shown in FIGS. 13A-13I and 14D-14L demonstrate longitudinally arranged heat radiation fins each having a section extending radially outward and a flair section extending circumferentially away from the radially extending fin section. It is noted that the example in FIG. 14A acceptable as well, but it does not include a flair section. A thermal transfer element, such as a heat pipe, includes a first section for extension into an interior of a bulb of the lamp. A second section extends from the first section and is coupled in heat communicative contact with the heat sink. A multi-surfaced three-dimensional thermal core, such as the thermal core examples in FIGS. 5A-11C, is attached to or integrated with and thermally coupled to the first section of the thermal transfer element to form a pedestal. The pedestal, such as shown in FIG. 1A, supports at least some solid state light emitters of the lamp on surfaces of the core in orientations to emit light outward from the pedestal through a bulb of the lamp in different principal directions. The radially extending sections of the fins have angular separation from each other so as to allow at least some light emitted via the bulb of the lamp to pass through spaces between the fins.

The multi-surfaced three-dimensional thermal core of the thermal system has at least three substantially flat surfaces (FIG. 5A) facing outward from a central axis of the pedestal in different directions for supporting at least some of the solid state light emitters in at least three different orientations so that principal directions of emission of light from the solid state light emitters 32 are radially outward from the thermal core in three different radial directions. Additionally, the multi-surfaced three-dimensional thermal core (FIG. 5C) has an end surface for supporting at least one of the solid state light emitters 32 in an orientation so that a principal direction of emission of light from the at least one solid state light emitter on the end surface is substantially the same as or parallel with the central longitudinal axis of the pedestal.

Attention is now directed to FIGS. 13A-14L which illustrate seven different examples of heat sink configurations that can be used in any of the preceding lamp examples. Orientations are shown by way of example, and directional terms such as upper or lower are used for convenience although obviously the bulb with the heat sink may be used in other orientations.

Figure 13A:
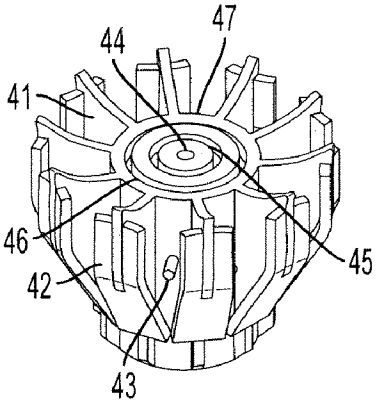
FIGS. 13A-13I are multiple views of three different examples of heat sink configurations.
Figure 13B:
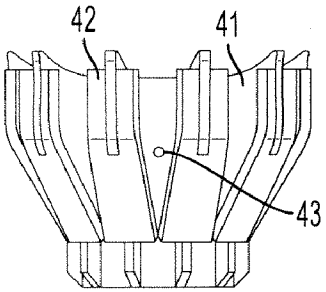
Figure 13C:
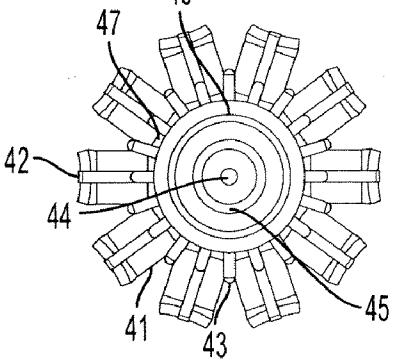

FIG. 13A is one example of a heat sink that can be used in any one of the previously described lamp configurations. FIGS. 13B and 13C are side and top views of the heat sink depicted in FIG. 13A. In FIG. 13A, the heat sink comprises a central core 47, and the upper portion of the core 47 includes several inner openings or rings 44, 45, 46. These openings or inner rings serve as the modular couplings of the heat sink for fixedly securing the thermal transfer element, the inner member and the bulb. The opening 44 is for receiving the axially extending portion of the thermal transfer element, such as the heat pipe 38, to extend through the upper portion of the heat sink into the interior of a bulb 31. Ring 45 is for the inner optical processing member 34 to be fixedly secured to the heat sink. The outermost ring 46 is for fixedly securing the bulb 31 to the heat sink.

Also shown in cross section in FIG. 2, the heat sink is generally hollow with the bulb side end (upper region in the illustrated orientation) of the hollow sink closed by the portion of the sink that extends across the sink and includes the rings and the opening for the thermal transfer element. However, the core extends in an approximately cylindrical shape from the end where the bulb and member attach to the end where the lamp base attaches.

Heat radiation fins 41 extend out from the cylindrical section of the heat sink core. Lengthwise, the fins extend in a direction parallel to the longitudinal axis of the heat sink and the lamp (vertical in the orientation of FIG. 13B). Laterally, the fins extend radially outward from the heat sink core and the axis (see top view of FIG. 13C). In addition to the radially extending fins 41, heat radiating pins 43 protrude from and are positioned around the heat sink, between adjacent fins 41, to further assist with heat dissipation from the lamp.

The radially extending sections of the fins have angular separation from each other so as to allow at least some light emitted via the globe to pass through spaces between the fins. The fins 41 in this example have a somewhat angled profile at their outer edges. The heat sink also includes flares 42 on the fins 41. In the example of FIG. 13A, the flares are located at distal ends of the fins 41 relative to inner core 47. The flares 42 are curved inward (as opposed to the outer circumferential curvature at the perimeter of the fins 41). The flares 42 are angled to follow at least a substantial portion of the angled outer contour of the fins 41. Some portions of the fins adjacent to the lamp base coupling are free of the flares. The extent of the fins upward or downward may be selected/modified to provide an increased light from the bulb through the spaces/openings of the heat sink.

Figure 13D:
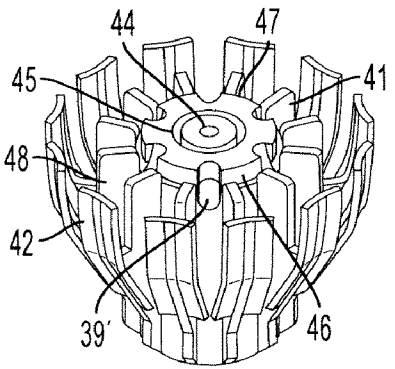
Figure 13E:
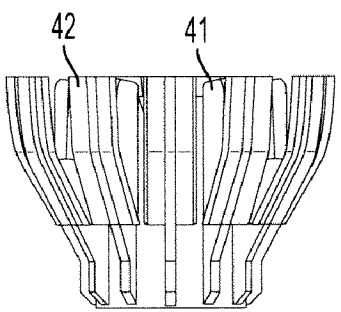
Figure 13F:
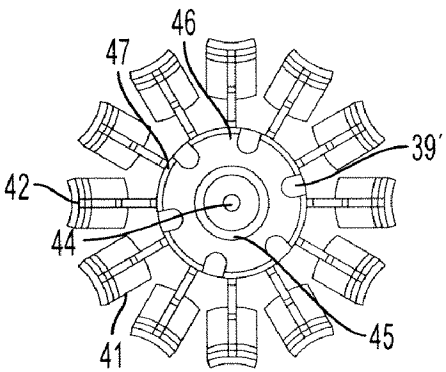

The heat sink example in FIG. 13D, is similar to the heat sink example shown in FIG. 12. FIGS. 13E and 13F are side and top views of the heat sink shown in FIG. 13D. The fins 41 have an angled outer profile at their outer edge. In the example of FIG. 13D, the flares 42 are located at the distal ends of the fins, and the flares 42 are angled to follow at least a substantial portion of the angled outer contour of the fins 41. The radially extending sections of the fins have angular separation from each other so as to allow at least some light emitted via the globe to pass through spaces between the fins. The fins 41 in this example have a somewhat angled profile at their outer edges. The heat sink also includes flares 42 on the fins 41. In the example of FIG. 13D, the flares are located at distal ends of the fins 41 relative to inner core 47. The flares 42 are curved inward (as opposed to the outer circumferential curvature at the perimeter of the fins 41). The flares 42 are angled to follow at least a substantial portion of the angled outer contour of the fins 41. Some portions of the fins adjacent to the lamp base coupling are free of the flares.

In this example, a cutout region 48 exists between the distal and proximal ends of each of the fins 41. Multiple air passages 39 extend around the core 47 to further facilitate with heat dissipation. The opening 44 is for receiving the axially extending portion of the thermal transfer element, such as the heat pipe 38, to extend through the upper portion of the heat sink into the interior of a bulb 31. Ring 45 is for the inner optical processing member 34 to be fixedly secured to the heat sink. The outermost ring 46 is for fixedly securing the bulb 31 to the heat sink.

Figure 13I:
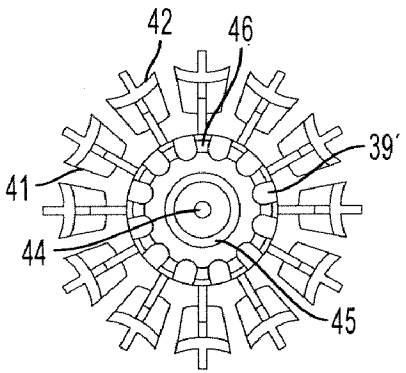
Figure 13H:
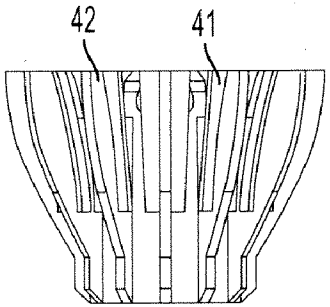
Figure 13G:
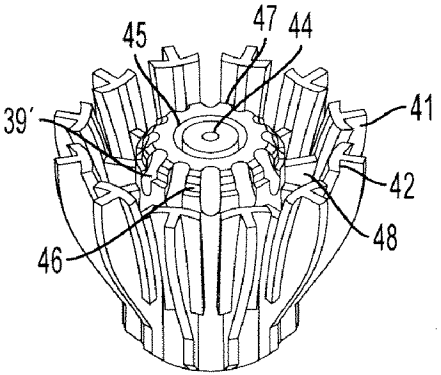

The heat sink example in FIG. 13G, is similar to what is shown in FIG. 1A. FIGS. 13H and 13I are side and top views of the heat sink shown in FIG. 13G. The fins 41 have an outward curved profile at their outer edges. The heat sink also includes flares on the fins. In the example of FIG. 13G, the flares are located between the proximal and distal ends of the fins, but the flares are longitudinally curved inward (as opposed to the outer curve at the perimeter of the fins). In a circumferential direction, the flairs also have inward curvature. In this example, a cutout region 48 exists between the distal and proximal ends of each of the fins 41. Multiple air passages 39' extend around the core 47 which assist with the thermal dissipation. The innermost ring 44 is an opening for the thermal transfer element to extend through. Ring 45 is for the inner optical processing member 34 to be fixedly secured to the heat sink. The outermost ring 46 is for fixedly securing the bulb 31 to the heat sink. Air passages 39' are provided to allow flow of air around the emitters and venting thereof to the exterior of the lamp. The passages 39' allow airflow from the interior of the bulb 31 to angled open areas between fins of the heat sink.

Attention is now directed to the additional examples of the heat sink configuration as shown in FIGS. 14A-14L. Orientations are shown by way of example, and directional terms such as upper or lower are used for convenience, although obviously the bulb with the heat sink may be used in other orientations. The heat sink is generally hollow with the bulb side end (upper region in the illustrated orientation) of the hollow sink closed by the portion of the heat sink that extends across the sink and includes the rings and the opening for the thermal transfer element). However, the core extends in an approximately cylindrical shape from the end where the bulb and member attach to the end where the lamp base attaches.

Figure 14D:
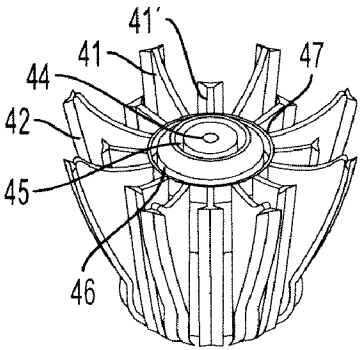
FIG. 14A-14L are multiple views of four additional examples of heat sink configurations.
Figure 14C:
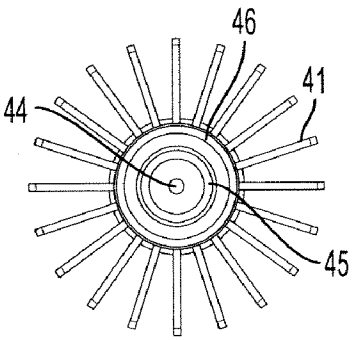
Figure 14B:
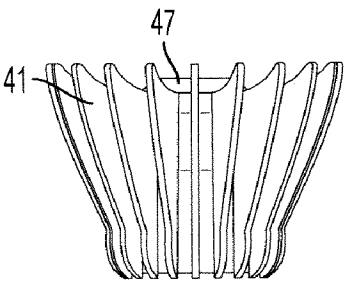
Figure 14A:
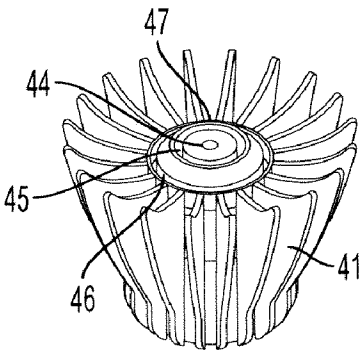

FIG. 14A illustrates a heat sink example where the fins include no flairs. FIGS. 14B and 14C are side and top views of what is shown in FIG. 14A. As seen in FIG. 14B, the fins 41 extend radially from the center core of the heat sink with the tip of the fin located at the distal end being at a higher elevation than the core 47 such that the bulb 31 is nested securely on the heat sink. The perimeter of the fins 41 at the distal end have an outer curve. The innermost ring 44 is an opening for the thermal transfer element to extend through. Ring 45 is for the inner optical processing member 34 to be fixedly secured to the heat sink. The outermost ring 46 is for fixedly securing the bulb 31 to the heat sink. Heat radiation fins 41 extend out from the cylindrical section of the heat sink core. Lengthwise, the fins extend in a direction parallel to the longitudinal axis of the heat sink and the lamp (vertical in the orientation of FIG. 14B). Laterally, the fins extend radially outward from the heat sink core and the axis (see top view of FIG. 14C).

Figure 14E:
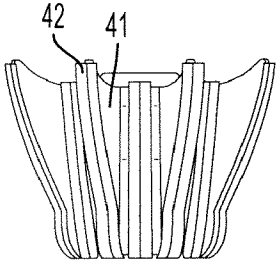
Figure 14F:
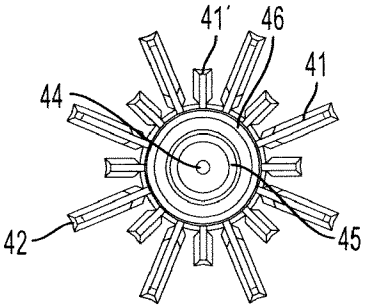

In the example shown in FIG. 14D, fins 41 extend further out from the core 47 than shorter fins 41'. FIGS. 14E and 14F are side and top views of the heat sink shown in FIG. 14D. The fins 41, 41' have an outward curved profile at their respective outer edges. The heat sink also includes flares on the fins. The extent of the fins upward or downward may be selected/modified to provide an increased light from the bulb through the spaces/openings of the heat sink. In the example of FIG. 14D, the flares are located at the distal ends of the fins, but the flares are longitudinally curved inward (as opposed to the outer curve at the perimeter of the fins). In a circumferential direction, the flairs also have inward curvature. The innermost ring 44 is an opening for the thermal transfer element to extend through. Ring 45 is for the inner optical processing member 34 to be fixedly secured to the heat sink. The outermost ring 46 is for fixedly securing the bulb 31 to the heat sink.

Figure 14G:
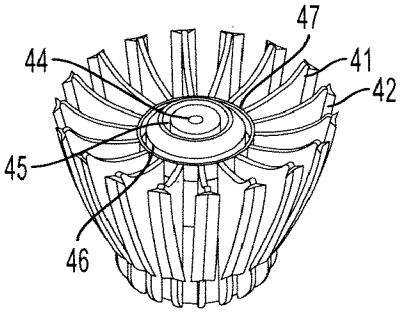
Figure 14H:
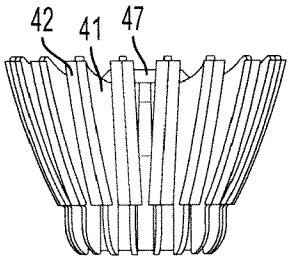
Figure 14I:
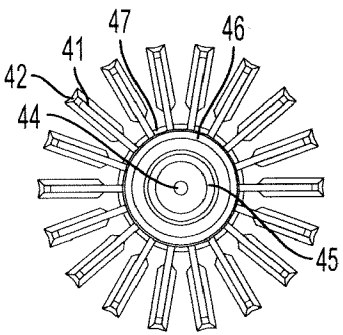

FIG. 14G illustrates another heat sink example where the fins include flairs. FIGS. 14H and 14I are side and top views of the heat sink shown in FIG. 14G. In FIG. 14G, the heat sink comprises a central core 47, and the upper portion of the core 47 includes several inner openings or rings 44, 45, 46. These openings or inner rings serve as the modular couplings of the heat sink for fixedly securing the thermal transfer element, the inner member and the bulb. The opening 44 is for receiving the axially extending portion of the thermal transfer element, such as the heat pipe 38, to extend through the upper portion of the heat sink into the interior of a bulb 31. Ring 45 is for the inner optical processing member 34 to be fixedly secured to the heat sink. The outermost ring 46 is for fixedly securing the bulb 31 to the heat sink.

As seen in FIG. 14H, the fins 41 extend from the center core 47 of the heat sink with the tip of the fin located at the distal end being at a higher elevation than the core 47. Heat radiation fins 41 extend out from the cylindrical section of the heat sink core. Lengthwise, the fins extend in a direction parallel to the longitudinal axis of the heat sink and the lamp (vertical in the orientation of FIG. 14H). Laterally, the fins extend radially outward from the heat sink core and the axis (see top view of FIG. 14I). The radially extending sections of the fins have angular separation from each other so as to allow at least some light emitted via the globe to pass through spaces between the fins. The fins 41 in this example have a somewhat curved profile at their outer edges. The heat sink also includes flares 42 on the fins 41. In the example of FIG. 14G, the flares are located at distal ends of the fins 41 relative to inner core 47. The flares 42 are curved inward (as opposed to the outer circumferential curvature at the perimeter of the fins 41). The flares 42 are curved to follow at least a substantial portion of the outer contour of the fins 41. Some portions of the fins adjacent to the lamp base coupling are free of the flares.

Figure 14J:
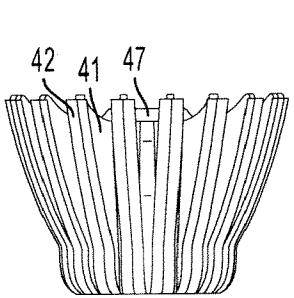
Figure 14K:
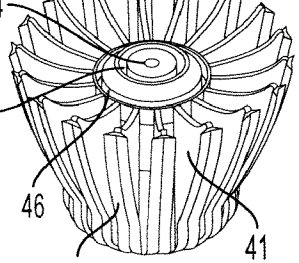
Figure 14L:
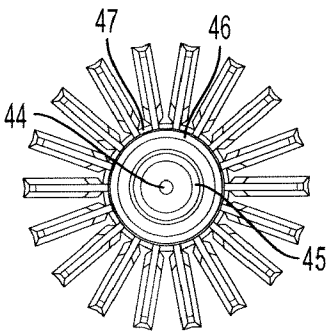

FIG. 14J illustrates another heat sink example where the fins include flairs. FIGS. 14K and 14L are side and top views of the heat sink shown in FIG. 14J. In FIG. 14J, the heat sink comprises a central core 47, and the upper portion of the core 47 includes several inner openings or rings 44, 45, 46. The opening 44 is for receiving the axially extending portion of the thermal transfer element, such as the heat pipe 38, to extend through the upper portion of the heat sink into the interior of a bulb 31. Ring 45 is for the inner optical processing member 34 to be fixedly secured to the heat sink. The outermost ring 46 is for fixedly securing the bulb 31 to the heat sink.

As seen in FIG. 14J, the fins 41 extend from the center core 47 of the heat sink with the tip of the fin located at the distal end being at a higher elevation than the core 47. Heat radiation fins 41 extend out from the cylindrical section of the heat sink core. Lengthwise, the fins extend in a direction parallel to the longitudinal axis of the heat sink and the lamp (vertical in the orientation of FIG. 14K). Laterally, the fins extend radially outward from the heat sink core and the axis (see top view of FIG. 14L). The radially extending sections of the fins have angular separation from each other so as to allow at least some light emitted via the globe to pass through spaces between the fins. The fins 41 in this example have a somewhat curved profile at their outer edges. The heat sink also includes flares 42 on the fins 41. In the example of FIG. 14J, the flares are located at distal ends of the fins 41 relative to inner core 47. The flares 42 are curved inward (as opposed to the outer circumferential curvature at the perimeter of the fins 41). The flares 42 are curved to follow at least a substantial portion of the outer contour of the fins 41. Some portions of the fins adjacent to the lamp base coupling are free of the flares.

The effects of radiation although often minimal when compared to the cooling effect of convection, especially when temperatures are not extremely elevated, can become more important when a system utilizes natural convection versus forced convection. To take advantage of extra cooling capacity provided through the process of radiation, the heat sink is finished to improve the emissivity of the heat sink surfaces.

The emissivity of an object relates to the ability of the object to radiate energy. Normally, the blacker the material, the better the emissivity. Conversely, the more reflective the material, the lower the emissivity. Emissivity, however, depends on a variety of factors, including wavelength of the energy to be emitted or radiated from surface(s) of the object. At the temperatures for dissipation from the sinks of solid state lamps like those under consideration here, the heat produces radiant energy of relatively long wavelengths outside the visible portion of the spectrum, e.g. in the infrared range. Some finishes that may appear reflective to an observer are reflective in the visible spectrum, but are actually darker in longer wavelength ranges outside the visible spectrum, such as in the infrared range. The improved emissivity may outweigh any thermal insulating effect of the finish in relation to the convective heat dissipation.

In any of the solid state lamps shown in the drawings, the surface finish on the outside of heat sink could be chosen to improve emissivity. For example, the finish could be a paint, powder coat, anodized surface or any other method that results in higher emissivity compared to the bare heat sink surface, whatever the material of or process used to produce the heat sink.

Of these exemplary finishes, white paint or powder coat may provide the greatest benefit due to the high emissivity in the infrared region and high reflectivity in the visible spectrum. The high reflectivity in the visible spectrum provides good light distribution in directions where light from the bulb passes between the heat sink fins. Black paint or powder coat provides similar emissivity in the infrared region but lacks the reflectivity of the white paint making it less suitable for lighting applications where the surfaces in question could absorb visible light that would otherwise exit the system.

Anodizing is another useful method for improving the emissivity when the heat sink has an aluminum based metallic surface. Of the various aluminum anodizing techniques, a clear anodized finish may be best suited for this application, in that it provides improved infrared radiation yet provides good reflectivity of visible light from the bulb.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. A lamp, comprising:

solid state light emitters;

a bulb;

a thermal handling system, comprising:

a heat sink;

a thermal core of a thermally conductive material, positioned in the interior of the bulb supporting the solid state light emitters; and a heat pipe coupled to the thermal core and the heat sink for supporting the thermal core, with the solid state emitters within the interior of the bulb, and for transferring heat generated by the solid state light emitters from the thermal core to the heat sink, wherein:

the heat pipe includes a first section extending along the longitudinal axis of the lamp into the interior of the bulb coupled to the thermal core, and a spiral-shaped second section connected to the first section and forming a spiral in heat communicative contact with the heat sink, at least one of the solid state light emitters is supported on an end of the thermal core in such an orientation so that a principal direction of emission of light from the at least one solid state light emitter is substantially the same as or parallel with a longitudinal axis of the lamp, and a plurality of the solid state light emitters are supported on one or more lateral surfaces of the thermal core in orientations so that principal directions of emission of light from the plurality of the solid state light emitters are radially outward from the thermal core in a plurality of different radial directions;

a lighting industry standard lamp base for providing electricity from a lamp socket;

circuitry connected to receive electricity from the lamp base, for driving the solid state emitters to emit light;

a circuit board attached to the thermal core for driving the solid state light emitters, wherein:

the circuit board extends vertically upward from the lamp base in an interior space within the heat sink, and the spiral shaped second section of the heat pipe coils around a portion of the circuit board.

2. The lamp of claim 1, wherein:

the thermal core has at least three substantially flat surfaces facing outward from the longitudinal axis of the lamp in different directions each supporting one or more of the plurality of the solid state light emitters in a different orientation, and the solid state light emitters on the thermal core produce combined emissions through the bulb approximating light source emissions from a filament of an incandescent bulb.

3. The lamp of claim 1, wherein the thermal core is formed as an integral element of the heat pipe.

4. The lamp of claim 1, wherein the first section of the heat pipe extends along an axis of the lamp substantially centered through the spiral of the second section of the heat pipe.

5. The lamp of claim 1, wherein the heat sink comprises:

an interior surface and longitudinally arranged heat radiation fins extending outward from the interior surface, each heat radiation fin having a section extending radially outward, wherein:

the spiral shaped second section of the heat pipe is in heat communicative contact with the interior surface of the heat sink, the heat sink supports the heat pipe within the lamp, and the heat generated by the solid state emitters is transferred from the spiral shaped second section of the heat pipe and the interior surface of the heat sink to the longitudinally arranged heat radiation fins.

6. The lamp of claim 5, wherein:

the first section of the heat pipe comprises a first end forming a hot interface for receiving the heat generated by the solid state emitters, the second section of the heat pipe comprises a second end for receiving the heat from the first end of the first section of the heat pipe, and the heat is transferred out of a cold interface at the second end of the second section of the heat pipe to the interior surface of the heat sink.

7. The lamp of claim 1, wherein the thermal core has a plurality of radially facing surfaces supporting the plurality of the solid state light emitters in the orientations to emit light radially outward in the plurality of different directions.

8. The lamp of claim 7, wherein each of the radially facing surfaces supports at least two solid state light emitters.

9. The lamp of claim 7, further comprising;

a flexible circuit board attached to the thermal core for providing electrical connections to the solid state emitters and for attaching the solid state emitters to the thermal core, wherein the flexible circuit board includes an end section supporting the at least one light emitter attached to the end of the thermal core, and a plurality of lateral sections each supporting one or more solid state emitters, the lateral sections being attached to respective radially facing surfaces of the thermal core.

10. The lamp of claim 1, wherein the thermal core comprises a material including electrical conductors so as to function as a circuit board for providing electrical connections to the solid state emitters.

11. The lamp of claim 10, wherein the solid state emitters comprise packaged light emitting diodes mounted on and connected to the thermal core circuit board.

12. The lamp of claim 10, wherein the solid state emitters comprise light emitting diode dies mounted on and connected to the thermal core circuit board.

13. A lamp, comprising:

solid state light emitters;

a bulb;

a thermal handling system, comprising:

a heat sink;

a thermal core of a thermally conductive material, positioned in the interior of the bulb supporting the solid state light emitters; and a heat pipe coupled to the thermal core and the heat sink for supporting the thermal core, with the solid state emitters within the interior of the bulb, and for transferring heat generated by the solid state light emitters from the thermal core to the heat sink, wherein:

the heat pipe includes a first section extending along the longitudinal axis of the lamp into the interior of the bulb coupled to the thermal core, and a spiral-shaped second section connected to the first section and forming a spiral in heat communicative contact with the heat sink, at least one of the solid state light emitters is supported on an end of the thermal core in such an orientation so that a principal direction of emission of light from the at least one solid state light emitter is substantially the same as or parallel with a longitudinal axis of the lamp, a plurality of the solid state light emitters are supported on one or more lateral surfaces of the thermal core in orientations so that principal directions of emission of light from the plurality of the solid state light emitters are radially outward from the thermal core in a plurality of different radial directions, and the heat sink comprises a plurality of longitudinally arranged heat radiation fins each having at least a section extending radially outward at an angle around a longitudinal axis of the lamp, the radiation fins having angular separation from each other so as to allow at least some of the light from the plurality of solid state emitters to pass through spaces between the radiation fins;

a lighting industry standard lamp base for providing electricity from a lamp socket; and circuitry connected to receive electricity from the lamp base, for driving the solid state emitters to emit light.

14. The lamp of claim 13, wherein the flairs are located at positions between proximal and distal ends of the radially extending fin sections.

15. The lamp of claim 13, wherein each of the heat radiation fins further comprises a flair section extending circumferentially away from the radially extending section of the fin.

16. The lamp of claim 15, wherein the flairs are at distal ends of the radially extending fin sections.

17. A lamp, comprising:

a plurality of solid state light emitters;

a bulb;

a heat sink;

a heat pipe comprising:

a first section extending into an interior of the bulb supporting the solid state light emitters, a plurality of the solid state light emitters being supported on the first section in orientations so that principal directions of emissions from the plurality are outward through the bulb in a plurality of different directions; and a spiral-shaped second section connected to and extending from the first section into the heat sink and forming a spiral in heat communicative contact with the heat sink;

a lighting industry standard lamp base for providing electricity from a lamp socket; and circuitry connected to receive electricity from the lamp base, for driving the solid state emitters to emit light, wherein the heat sink comprises a plurality of longitudinally arranged heat radiation fins each having at least a section extending radially outward at an angle around a longitudinal axis of the lamp, the radiation fins having angular separation from each other so as to allow at least some emissions by way of the bulb to pass through spaces between the radiation fins.

* * * * *